US008053987B2

(12) United States Patent
Egi et al.

(10) Patent No.: US 8,053,987 B2
(45) Date of Patent: Nov. 8, 2011

(54) PLASMA DISPLAY PANEL AND FIELD EMISSION DISPLAY

(75) Inventors: Yuji Egi, Kanagawa (JP); Jiro Nishida, Kanagawa (JP); Takeshi Nishi, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 787 days.

(21) Appl. No.: 11/950,663

(22) Filed: Dec. 5, 2007

(65) Prior Publication Data

US 2008/0129183 A1 Jun. 5, 2008

(30) Foreign Application Priority Data

Dec. 5, 2006 (JP) ..... 2006-328265

(51) Int. Cl.
*H01J 17/49* (2006.01)
*H01J 5/16* (2006.01)

(52) U.S. Cl. ..... 313/582; 313/110

(58) Field of Classification Search ..... 313/582, 313/110

See application file for complete search history.

(56) References Cited

U.S. PATENT DOCUMENTS

| | | | | |
|---|---|---|---|---|
| 4,721,361 | A | 1/1988 | Van de Ven | |
| 4,883,343 | A | 11/1989 | Teshirogi | |
| 5,805,252 | A | 9/1998 | Shimada et al. | |
| 5,939,826 | A * | 8/1999 | Ohsawa et al. | 313/582 |
| 6,255,705 | B1 | 7/2001 | Zhang et al. | |
| 6,261,665 | B1 | 7/2001 | Murata et al. | |
| 6,426,787 | B1 | 7/2002 | Satake et al. | |
| 6,433,841 | B1 | 8/2002 | Murade et al. | |
| 6,468,844 | B1 | 10/2002 | Yamazaki et al. | |
| 6,576,926 | B1 | 6/2003 | Yamazaki et al. | |
| 6,635,986 | B2 | 10/2003 | Yaniv et al. | |
| 6,777,254 | B1 | 8/2004 | Yamazaki et al. | |
| 6,811,274 | B2 | 11/2004 | Olczak | |
| 6,825,896 | B2 | 11/2004 | Goto et al. | |

(Continued)

FOREIGN PATENT DOCUMENTS

JP 07-168006 7/1995

(Continued)

OTHER PUBLICATIONS

PCT International Search Report mailed Feb. 5, 2008 for PCT International Application No. PCT/JP2007/073286 (PCT10176) filed Nov. 27, 2007.

(Continued)

*Primary Examiner* — Karabi Guharay
(74) *Attorney, Agent, or Firm* — Nixon Peabody LLP; Jeffrey L. Costellia

(57) ABSTRACT

It is an object of the present invention to provide a PDP and an FED with excellent visibility and a high level of reliability that each have an antireflective function by which reflection of external light can be reduced. A plurality of adjacent pyramidal-shaped projections and an antireflective layer equipped with a covering film that covers the projections are provided. The reflection of light is prevented by the index of refraction of incident light from external being changed by a pyramid, which is a physical shape, projecting out toward an external side (atmosphere side) of a substrate that is to be used as a display screen as well as by the covering film used to cover the projections being formed of a material that has a higher index of refraction than the index of refraction of the pyramidal projection.

15 Claims, 27 Drawing Sheets

U.S. PATENT DOCUMENTS

| | | | | |
|---|---|---|---|---|
| 6,833,665 | B2 | 12/2004 | Wachi et al. | |
| 6,951,400 | B2 | 10/2005 | Chisholm et al. | |
| 7,094,452 | B2 | 8/2006 | Yamashita et al. | |
| 7,151,580 | B2 | 12/2006 | Ueki et al. | |
| 7,297,386 | B2 | 11/2007 | Suzuki et al. | |
| 7,301,264 | B2 | 11/2007 | Ohsawa | |
| 7,659,669 | B2 * | 2/2010 | Nishida et al. | 313/582 |
| 2001/0030638 | A1 * | 10/2001 | Kashima | 345/102 |
| 2002/0044356 | A1 | 4/2002 | Arakawa et al. | |
| 2002/0101155 | A1 | 8/2002 | Kimura | |
| 2003/0102286 | A1 | 6/2003 | Takahara et al. | |
| 2003/0169386 | A1 | 9/2003 | Goto et al. | |
| 2003/0180476 | A1 | 9/2003 | Yamashita et al. | |
| 2004/0109303 | A1 | 6/2004 | Olczak | |
| 2004/0109305 | A1 | 6/2004 | Chisholm | |
| 2004/0191478 | A1 | 9/2004 | Nishikawa et al. | |
| 2004/0201795 | A1 | 10/2004 | Paukshto | |
| 2004/0227446 | A1 | 11/2004 | Fujimoto et al. | |
| 2005/0030461 | A1 | 2/2005 | Ono et al. | |
| 2005/0053790 | A1 | 3/2005 | Kato | |
| 2005/0074579 | A1 | 4/2005 | Suzuki et al. | |
| 2005/0190321 | A1 | 9/2005 | Ohsawa | |
| 2005/0245078 | A1 | 11/2005 | Ohnuma et al. | |
| 2006/0012736 | A1 | 1/2006 | Nishino et al. | |
| 2006/0050387 | A1 | 3/2006 | Arakawa et al. | |
| 2006/0119269 | A1 * | 6/2006 | Park | 313/582 |
| 2006/0139749 | A1 | 6/2006 | Watanabe et al. | |
| 2006/0172119 | A1 | 8/2006 | Hayashi et al. | |
| 2006/0245060 | A1 | 11/2006 | Goto | |
| 2006/0250064 | A1 | 11/2006 | Park et al. | |
| 2007/0115573 | A1 | 5/2007 | Gueyvandov et al. | |
| 2007/0131928 | A1 | 6/2007 | Kwak et al. | |
| 2007/0284991 | A1 | 12/2007 | Egi | |
| 2008/0001156 | A1 | 1/2008 | Sakakura et al. | |
| 2008/0042926 | A1 | 2/2008 | Egi et al. | |
| 2008/0129184 | A1 | 6/2008 | Nishida et al. | |
| 2008/0129188 | A1 | 6/2008 | Egi et al. | |
| 2008/0129933 | A1 | 6/2008 | Nishida et al. | |
| 2008/0130122 | A1 | 6/2008 | Egi et al. | |
| 2008/0144180 | A1 | 6/2008 | Nishida et al. | |
| 2008/0158682 | A1 | 7/2008 | Egi et al. | |
| 2008/0165315 | A1 | 7/2008 | Nishida et al. | |
| 2010/0002306 | A1 | 1/2010 | Goto | |

FOREIGN PATENT DOCUMENTS

| | | |
|---|---|---|
| JP | 08-297202 | 11/1996 |
| JP | 2001-264520 | 9/2001 |
| JP | 2003-177207 | 6/2003 |
| JP | 2003177207 A * | 6/2003 |
| JP | 2003-240904 | 8/2003 |
| JP | 2003-248102 | 9/2003 |
| JP | 2003-279705 | 10/2003 |
| JP | 2003-295778 | 10/2003 |
| JP | 2004-085831 | 3/2004 |
| JP | 2004-177781 | 6/2004 |
| JP | 2004-291500 | 10/2004 |
| JP | 2005-064324 | 3/2005 |
| JP | 2005-176457 | 6/2005 |
| JP | 2005-181740 | 7/2005 |
| JP | 2005-264099 | 9/2005 |
| JP | 2006-010831 | 1/2006 |
| JP | 2006-509240 | 3/2006 |
| JP | 2006-133617 | 5/2006 |
| JP | 2006-171229 | 6/2006 |
| JP | 2006-189784 | 7/2006 |
| JP | 2006-313360 | 11/2006 |
| WO | WO-2004/051325 A1 | 6/2004 |
| WO | WO-2005/010572 A1 | 2/2005 |
| WO | WO-2005/088355 A1 | 9/2005 |

OTHER PUBLICATIONS

PCT Written Opinion of the International Searching Authority mailed Feb. 5, 2008 for PCT International Application No. PCT/JP2007/073286 (PCT10176) filed Nov. 27, 2007.

"International Search Report (Application No. PCT/JP2007/073285; PCT10171) Dated Jan. 8, 2008,".

"Written Opinion (Application No. PCT/JP2007/073285; PCT10171) Dated Jan. 8, 2008,".

"International Search Report (Application No. PCT/JP2007/073436; PCT10169) Dated Jan. 8, 2008,".

"Written Opinion (Application No. PCT/JP2007/073436; PCT10169) Dated Jan. 8, 2008,".

"International Search Report (Application No. PCT/JP2007/073289; PCT10172) Dated Jan. 8, 2008,".

"Written Opinion (Application No. PCT/JP2007/073289; PCT10172) Dated Jan. 8, 2008,".

"International Search Report (Application No. PCT/JP2007/073430; PCT10170) Dated Jan. 8, 2008,".

"Written Opinion (Application No. PCT/JP2007/073430; PCT10170) Dated Jan. 8, 2008,".

"International Search Report (Application No. PCT/JP2007/073432; PCT10175) Dated Jan. 8, 2008,".

"Written Opinion (Application No. PCT/JP20071073432; PCT10175) Dated Jan. 8, 2008,".

"International Search Report (Application No. PCT/JP2007/073125; PCT10174) Dated Jan. 15, 2008,".

"Written Opinion (Application No. PCT/JP2007/073125; PCT10174) Dated Jan. 15, 2008,".

"Written Opinion (Application No. PCT/JP2007/073434; PCT10173) Dated Jan. 8, 2008,".

"International Search Report (Application No. PCT/JP2007/073434; PCT10173) Dated Jan. 8, 2008,".

* cited by examiner

FIG. 3A1
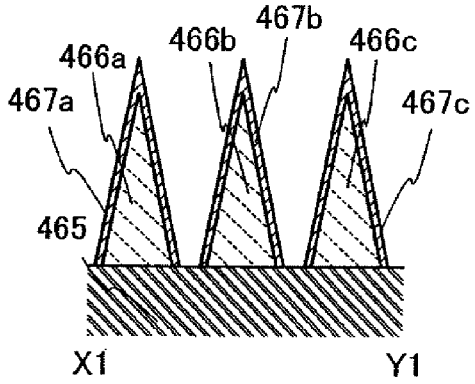
FIG. 3A2
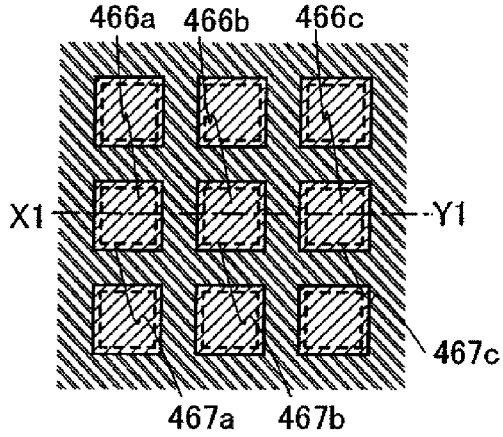
FIG. 3B1
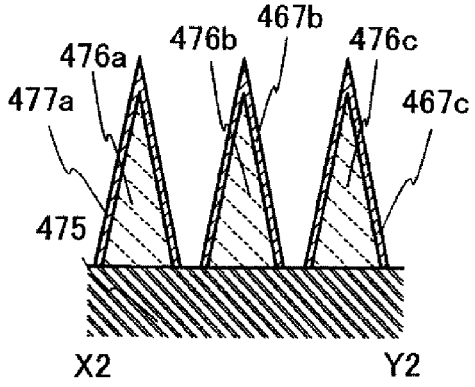
FIG. 3B2
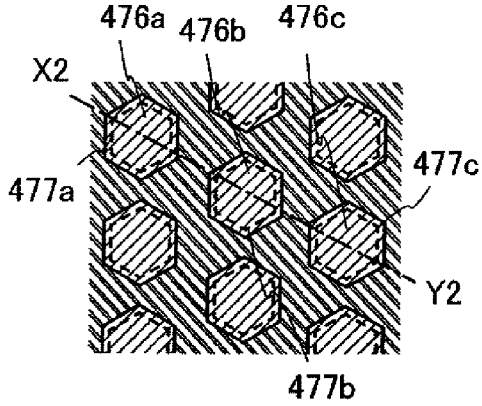
FIG. 3C1
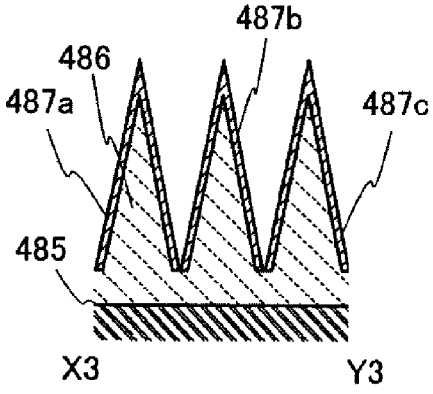
FIG. 3C2
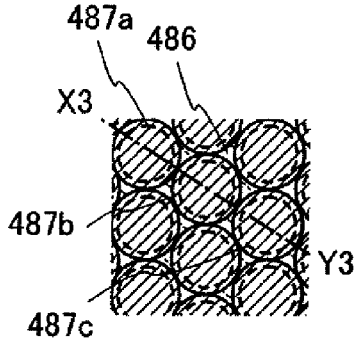

PLASMA DISPLAY PANEL AND FIELD EMISSION DISPLAY

TECHNICAL FIELD

The present invention relates to a plasma display panel and a field emission display that each have an antireflective function.

BACKGROUND ART

In various types of displays (a plasma display panel (hereinafter referred to as a PDP), a field emission display (hereinafter referred to as an FED)) and the like), the display screen becomes hard to see and visibility decreases because of reflection of scenery due to surface reflection of light from external. These are particularly significant problems with regard to increase in the size of a display device or use of a display device outdoors.

Methods in which antireflective films are provided in PDP and FED display screens in order to prevent reflection of light from external in this way are being implemented. For example, there is a method in which, for an antireflective film, the structure is set to be a multilayer structure in which layers of different indices of refraction are stacked together so as to be effective against a wide range of wavelengths of visible light (for an example of this method, refer to Patent Document 1). By the structure being made to be a multilayer structure, an antireflective effect can be obtained in which light from external reflected at interfaces of the stacked layers interferes with itself and cancels out.

Furthermore, for an antireflective structure, minute conical or pyramidal projections are arranged over a substrate and the reflectance of the surface of the substrate is reduced (for an example of this structure, refer to Patent Document 2).

Patent Document 1: Japanese Published Patent Application No. 2003-248102

Patent Document 2: Japanese Published Patent Application No. 2004-85831

DISCLOSURE OF INVENTION

However, in the multilayer structure described above, part of the light from external that is reflected at an interface between layers does not cancel out and is transmitted to the viewer side of the display as reflected light. Furthermore, in order to make the light from external cancel itself out, there is a need to closely control the optical characteristics, film thicknesses, and the like of materials used for the films that are stacked together, and it is difficult to perform antireflective processes with respect to all light that is incident from external from a variety of different angles. In addition, even with the conical or pyramidal antireflective structures, there has not been enough antireflective function.

By what is described above, there are limits on the functionality of conventional antireflective films, and there is a demand for PDPs and FEDs that have a higher level of antireflective function.

It is an object of the present invention to provide a PDP and an FED with excellent visibility that each have an antireflective function by which reflection of external light can be reduced.

The present invention is a PDP and an FED that each have an antireflective layer that is used to prevent reflection of light by provision of a plurality of adjacent pyramidal-shaped projections (hereinafter referred to as pyramidal projections) such that the index of reflection is changed by a pyramid, which is a physical shape, projecting out toward an external side (atmosphere side) of a substrate that is to be used as a display screen. Furthermore, the antireflective layer is one in which the plurality of pyramidal projections is covered by a covering film formed of a material that has a higher index of refraction than the index of refraction of the pyramidal projection.

By covering of the surface of the pyramidal projection with a covering film that has a high index of refraction, for light that propagates toward external from the pyramidal projection, the amount of light that is reflected within the pyramidal projection at an interface between the covering film and the atmosphere increases. Furthermore, by refraction of light at the interface between the covering film and the pyramidal projection, the direction of propagation of light within the pyramidal projection comes to be nearly perpendicular to the base of the pyramidal projection, and because light is incident on the base (the display screen), the number of times light is reflected within the pyramidal projection is reduced.

Because the reflection of light to external from the pyramidal projection can be prevented, even if there is a planar portion between adjacent pyramidal projections with a space between pyramidal projections, the reflection of light to a viewer side by the planar portion can be prevented. That is to say, even if there is some space between at least one side that forms the base of the pyramid of one of the pyramidal projections and a side that forms the base of the pyramid of an adjacent pyramidal projection, the reflection of light in the planar portion to a viewer side can be prevented. Because the amount of reflection of incident light from external at the planar portion to a viewer side can be reduced, the range of selection for the shape of the pyramidal projections, settings for arrangement, and manufacturing steps can be extended.

In addition, by stacked-layering of a pyramidal projection and a covering film, where there is a difference in indices of refraction therebetween, for light from the atmosphere that is incident on the covering film and the pyramidal projection, there is an effect in that the amount of reflected light is decreased due to the occurrence of optical interference between light reflected at an interface between the atmosphere and the covering film and light reflected at an interface between the covering film and the pyramidal projection.

In the present invention, when the difference between the index of refraction of the covering film and that of the pyramidal projection is high, it is preferable that the film thickness of the covering film be thin.

For the pyramidal projection, it is preferable that the pyramidal projection be a shape such as a conical shape that has an infinite number of sides in the normal direction because light can be dispersed effectively in a variety of directions with this kind of shape, and the level of antireflective function can be increased.

The pyramidal projection may have a conical shape, a polyhedral shape (triangular pyramid, square pyramid, pentagonal pyramid, hexagonal pyramid, or the like), or a needle shape; the tip of the pyramid may be flat where a cross section thereof is trapezoidal, a dome shape where the tip is rounded, or the like.

Furthermore, by covering of the pyramidal projection with a covering film, physical strength of the pyramidal projection can be increased, and reliability is improved. By selection of a material for the covering film so that the covering film is made to be conductive, other useful functions can be provided, such as granting of an antistatic function and the like.

By the present invention, a PDP and an FED that each have an antireflective layer that has a plurality of adjacent pyramidal projections can be provided, and a high-level antireflective function can be granted.

A PDP may refer to a display panel main body with discharge cells as well as a display panel to which is attached a flexible printed circuit (an FPC) or a printed wiring board (a PWB) provided with one or more of an IC, a resistor, a capacitor, an inductor, a transistor, and the like. Furthermore, an optical filter that has an electromagnetic shield function or a near-infrared shielding function may be included, as well.

In addition, an FED may refer to a display panel main body with light-emitting cells as well as a display panel to which is attached a flexible printed circuit (an FPC) or a printed wiring board (a PWB) provided with one or more of an IC, a resistor, a capacitor, an inductor, a transistor, and the like. Furthermore, an optical filter that has an electromagnetic shield function or a near-infrared shielding function may be included, as well.

The PDP and FED of the present invention each have an antireflective layer that has a plurality of pyramidal projections over its surface. Because a side of the pyramidal projection is not planar (a surface parallel to a display screen), incident light from external is not reflected toward a viewer side but is reflected toward other, adjacent pyramidal projections. Part of the incident light is transmitted through the pyramidal projection, and the rest of the incident light is incident on an adjacent pyramidal projection as reflected light. In this way, light incident from external that is reflected at an interface between adjacent pyramidal projections is repeatedly incident on other pyramidal projections.

That is, for the part of the incident light from external that is incident on the antireflective layer, because the number of times the light is incident on the pyramidal projections of the antireflective layer increases, the amount of light transmitted through the pyramidal projection of the antireflective layer is increased. Consequently, the amount of the incident light from external that is reflected to the viewer side is reduced, and reflections and the like that cause reduction in visibility can be prevented.

When light is incident on a material that has a low index of refraction from a material that has a high index of refraction, total reflection of all light occurs more readily when the difference in indices of refraction is high. By covering of the surface of the pyramidal projection with a covering film that has a high index of refraction, for light that propagates toward external from the pyramidal projection, the amount of light that is reflected within the pyramidal projection at an interface between the covering film and the atmosphere increases. Furthermore, by refraction of light at the interface between the covering film and the pyramidal projection, the direction of propagation of light within the pyramidal projection comes to be nearly perpendicular to the base of the pyramidal projection, and because light is incident on the base (the display screen), the number of times light is reflected within the pyramidal projection is reduced. Consequently, by the pyramidal projection being covered with a covering film that has a high index of reflection, there is an improvement in the effect of confinement of light to within the pyramidal projection, and the reflection of light to external from the pyramidal projection can be decreased.

Because the reflection of light to external from the pyramidal projection can be prevented, even if there is a planar portion between adjacent pyramidal projections with space between the adjacent pyramidal projections, the reflection of light to a viewer side at the planar portion can be prevented.

In addition, by stacked-layering of a pyramidal projection and a covering film, where there is a difference in indices of refraction therebetween, for light from the atmosphere that is incident on the covering film and the pyramidal projection, there is an effect in that the amount of reflected light is decreased due to the occurrence of optical interference between light reflected at an interface between the atmosphere and the covering film and light reflected at an interface between the covering film and the pyramidal projection.

Furthermore, by covering of the pyramidal projection with a covering film, physical strength of the pyramidal projection can be increased, and reliability is improved. By selection of a material for the covering film so that the covering film is made to be conductive, other useful functions can be provided, such as granting of an antistatic function and the like.

In the present invention, a PDP and an FED that each have an antireflective layer that has a plurality of pyramidal projections over its surface and an even higher level antireflective function by which the reflection of incident light from external can be reduced by covering of the pyramidal projections with covering films, where each of the covering films has a higher index of refraction than that of the pyramidal projection, can be provided. Consequently, a PDP and an FED, each with even higher image quality and higher performance, can be manufactured.

BRIEF DESCRIPTION OF DRAWINGS

FIGS. 3A1 and 3A2, 3B1 and 3132, and 3C1 and 3C2 are conceptual diagrams of the present invention.

BEST MODE FOR CARRYING OUT THE INVENTION

Figure 1A:
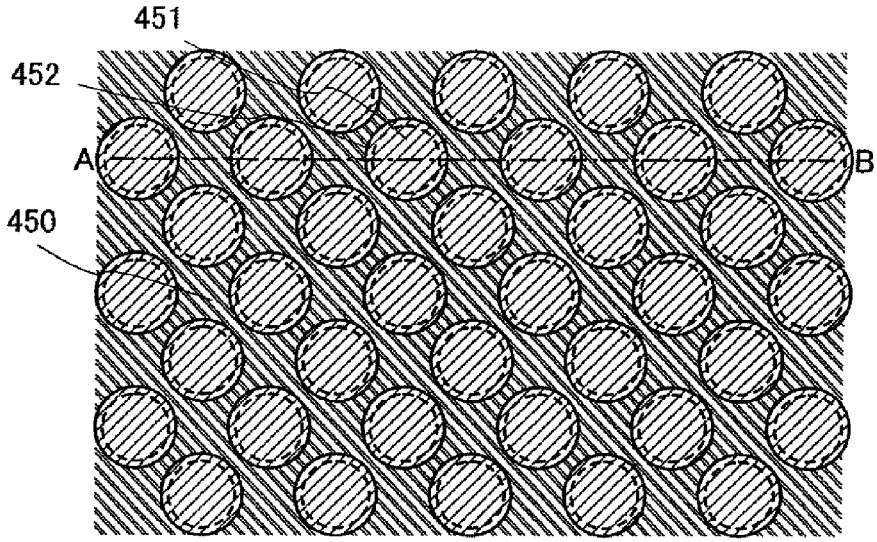
FIGS. 1A to 1C are conceptual diagrams of the present invention.

Hereinafter, Embodiment Modes of the present invention will be described based on drawings. However, the present invention can be implemented in a lot of different modes, and it is to be easily understood by those skilled in the art that various changes and modifications can be made without any departure from the spirit and scope of the present invention. Accordingly, the present invention is not to be taken as being limited to the described content of the embodiment modes included herein. It is to be noted that identical portions or portions having similar functions in all figures used to describe embodiment modes are denoted by the same reference numerals, and repetitive description thereof is omitted.

Embodiment Mode 1

In the present embodiment mode, in a PDP and an FED of the present invention, an antireflective layer provided in a PDP or an FED will be described. Specifically, an example of an antireflective layer that has an antireflective function by which the reflection of light from external on a surface of the PDP or FED can be reduced and which is used to grant excellent visibility to a PDP or an FED.

Figure 1B:
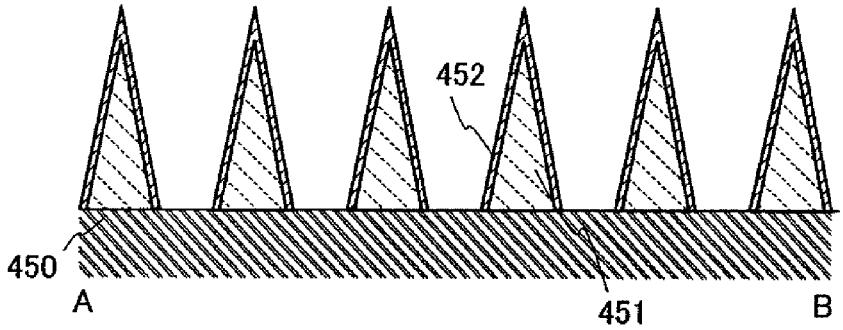
Figure 1C:
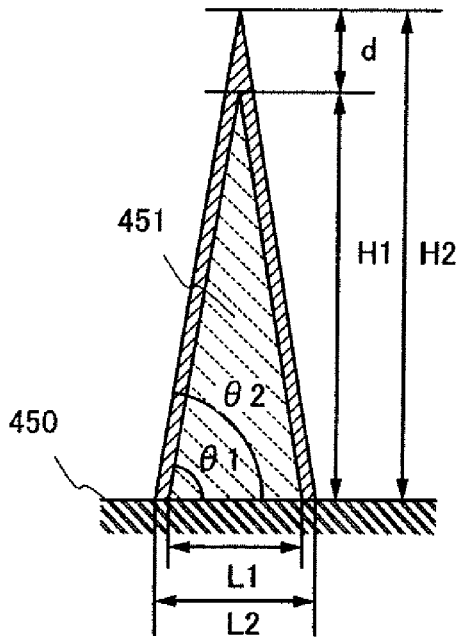

FIG. 1A is a top-view diagram and FIGS. 1B and 1C are cross-sectional view diagrams of an antireflective layer used in the present invention. In FIGS. 1A to 1C, a plurality of projections 451 and a covering film 452 are provided over a display screen 450. The antireflective layer is made up of the plurality of projections 451 and the covering film 452. FIG. 1A is a top-view diagram of a PDP or an FED of the present embodiment mode, and FIG. 1B is a diagram of a cross section taken along line A-B in FIG. 1A. FIG. 1C is an exploded-view diagram of FIG. 1B. As shown in FIGS. 1A and 1B, the projections 451 are provided over a display screen adjacent to each other with some space between adjacent projections, and a planar portion in which no pyramidal projection is formed exists in a substrate that is to be used as a display screen with respect to light from external incident between pyramidal projections. That is to say, even if there is some space between at least one side that forms the base of the pyramid of one of the pyramidal projections and one side that forms the base of the pyramid of an adjacent pyramidal projection, the reflection of light by the planar portion to a viewer side can be prevented. It is to be noted that, the "display screen" given here refers to a surface on the viewer side of a substrate that is provided on the most visible side out of a plurality of substrates that form a display device.

In FIG. 1C, a height $H_1$ of a pyramidal projection is the height from the base of the pyramidal projection to the apex, and the difference d in height between the apex of a covering film and the apex of the pyramidal projection is added to the height $H_1$ of the pyramidal projection to give a height $H_2$, which is the height of the pyramidal projection covered by the covering film. Furthermore, a width $L_1$ of the base of the pyramidal projection (in the present embodiment mode, the pyramidal projection is a conical shape, so the base is a circle, and the width $L_1$ is the diameter thereof), and a portion of the covering film that comes into contact with the base is added to the width $L_1$ of the base of the pyramidal projection to give a width $L_2$, which is the width of the pyramidal projection covered by the covering film. In the same way, an angle $\theta_1$ is an angle of an oblique side with respect to the base of the pyramidal projection, and an angle $\theta_2$ is an angle of an oblique side with respect to the base of the pyramidal projection covered by the covering film.

The antireflective layer of the present invention is used to prevent reflection of light by provision of a plurality of adjacent pyramidal-shaped projections (hereinafter referred to as pyramidal projections) such that the index of reflection is changed by a pyramid, which is a physical shape, projecting out toward an external side (atmosphere side) of a surface of a substrate that is to be used as a display screen. Furthermore, the antireflective layer of the present invention is one in which the plurality of pyramidal projections is covered by a covering film that is formed of a material that has a higher index of refraction than the index of refraction of the pyramidal projection.

Figure 4:
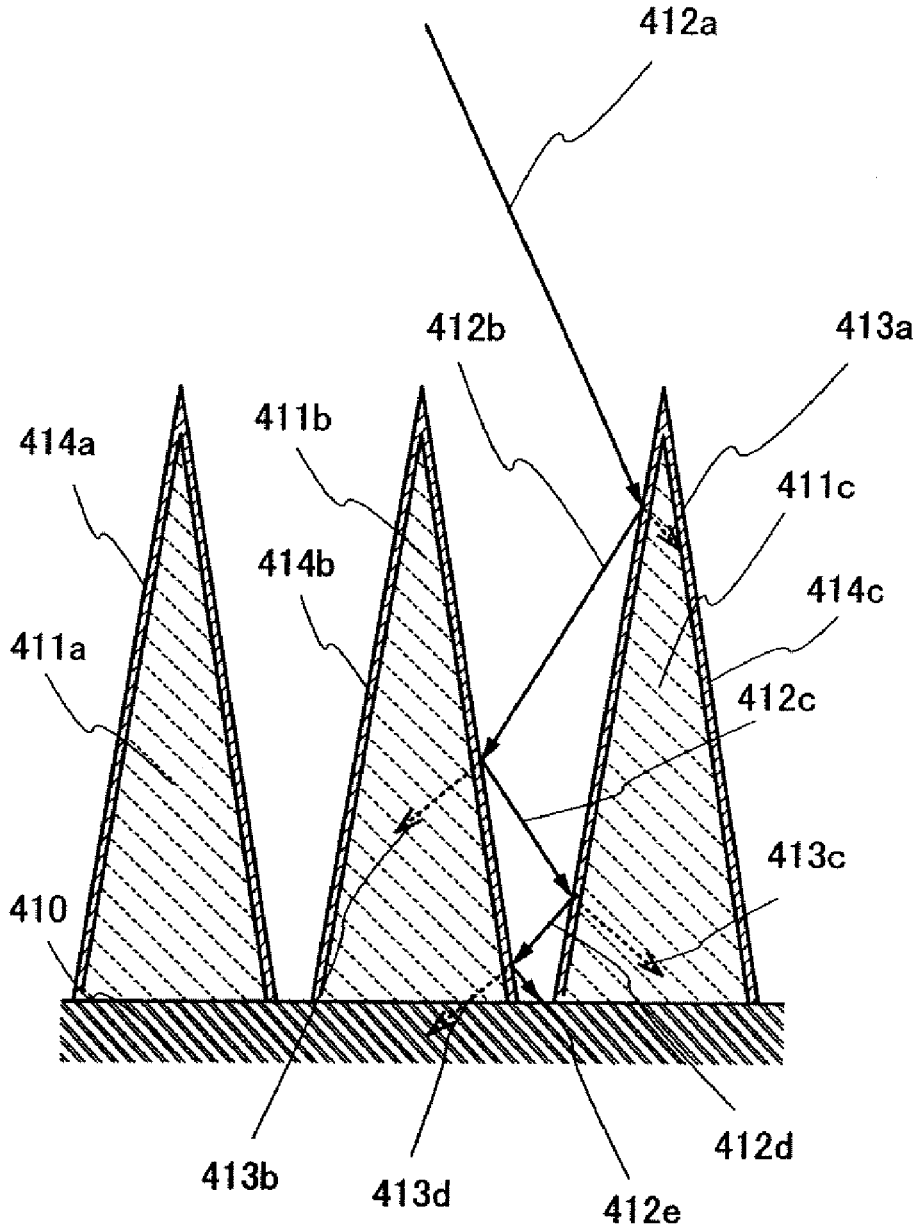
FIG. 4 is a conceptual diagram of the present invention.

An antireflective function in a plurality of pyramidal projections of the present embodiment mode to which the present invention is applied is described using FIG. 4. In FIG. 4, pyramidal projections 411*a*, 411*b*, and 411*c*, which are adjacent to each other with a space between adjacent projections, and covering films 414*a*, 414*b*, and 414*c* formed over a substrate 410 that is to be used as a display screen are shown. An incident light ray 412*a* from external is incident on the pyramidal projection 411*c* that is covered by the covering film 414*c*, where part of the incident light ray 412*a* enters the covering film 414*c* and the pyramidal projection 411*c* as a transmitted light ray 413*a* and the other part of the incident light ray 412*a* is reflected off the surface of the covering film 414*c* or pyramidal projection 411*c* as a reflected light ray 412*b*. The reflected light ray 412*b* is incident on the adjacent pyramidal projection 411*b* that is covered by the covering film 414*b*, where part of the reflected light ray 412*b* is transmitted as a transmitted light ray 413*b* and the other part of the reflected light ray 412*b* is reflected off the surface of the covering film 414*b* or pyramidal projection 411*b* as a reflected light ray 412*c*. The reflected light ray 412*c* is incident on the adjacent pyramidal projection 411*c* that is covered by the covering film 414*c*, where part of the reflected light ray 412*c* is transmitted as a transmitted light ray 413*c* and the other part of the reflected light ray 412*c* is reflected off the surface of the covering film 414*c* or pyramidal projection 411*c* as a reflected light ray 412*d*. The reflected light ray 412*d* is incident on the adjacent pyramidal projection 411*b*, where part of the reflected light ray 412*d* is transmitted as a transmitted light ray 413*d* and the other part of the reflected light ray 412*d* is reflected off the surface of the covering film 414*b* or pyramidal projection 411*b* as a reflected light ray 412*e*.

In this way, the antireflective layer of the present embodiment mode has a plurality of pyramidal projections over its surface, and because an interface between pyramidal projections is not planar (a surface parallel to a display screen), reflected light of light incident from external is not reflected toward a viewer side but is reflected toward other, adjacent pyramidal projections. Part of the incident light is transmitted through the pyramidal projection, and the rest of the incident light is incident on an adjacent pyramidal projection as reflected light. In this way, light incident from external that is reflected at an interface between adjacent pyramidal projections is repeatedly incident on other pyramidal projections.

That is, for the part of the incident light from external that is incident on the pyramidal projection, because the number of times the light is incident on the pyramidal projections increases, the amount of light transmitted through the pyramidal projection is increased. Consequently, the amount of the incident light from external that is reflected to the viewer side is reduced, and reflections and the like that cause reduction in visibility can be prevented.

Furthermore, in the present embodiment mode, the pyramidal projection is covered by a covering film that has a higher index of refraction than the pyramidal projection. Advantages in using the covering film are described using FIGS. 5A and 5B and FIG. 6.

Figure 6:
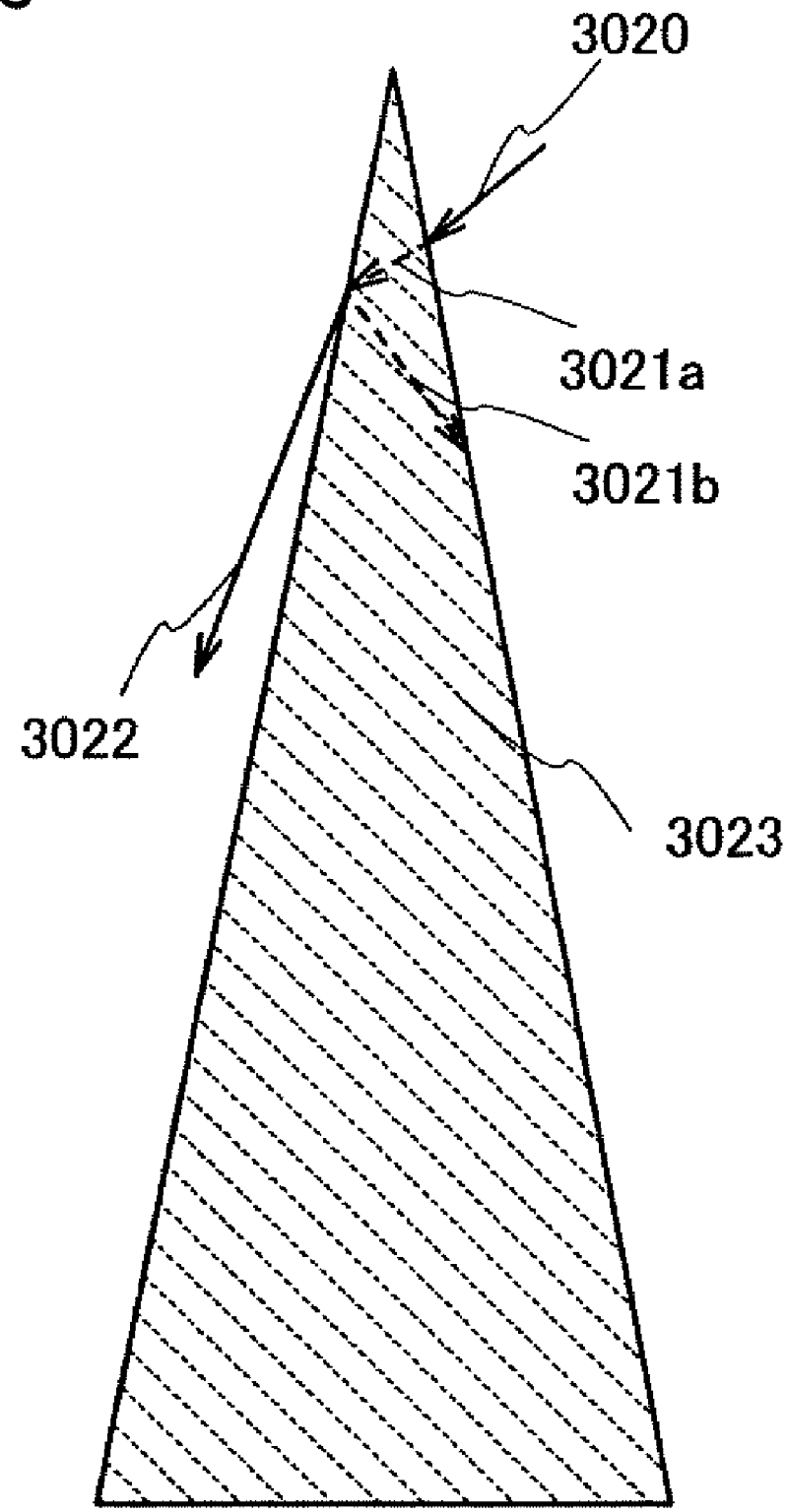
FIG. 6 is a diagram illustrating an experimental model of a comparative example.

FIG. 6 is a comparative example that is an example of a pyramidal projection that is not covered by a covering film. An incident light ray 3020 from external is incident on a pyramidal projection 3023 and propagates through the pyramidal projection 3023 as a transmitted light ray 3021*a*. At an interface, one part of the transmitted light ray 3021*a* is transmitted through the pyramidal projection 3023 to external as a transmitted light ray 3022, and the other part propagates through the pyramidal projection 3023 as a reflected light ray 3021*b*.

Figure 5A:
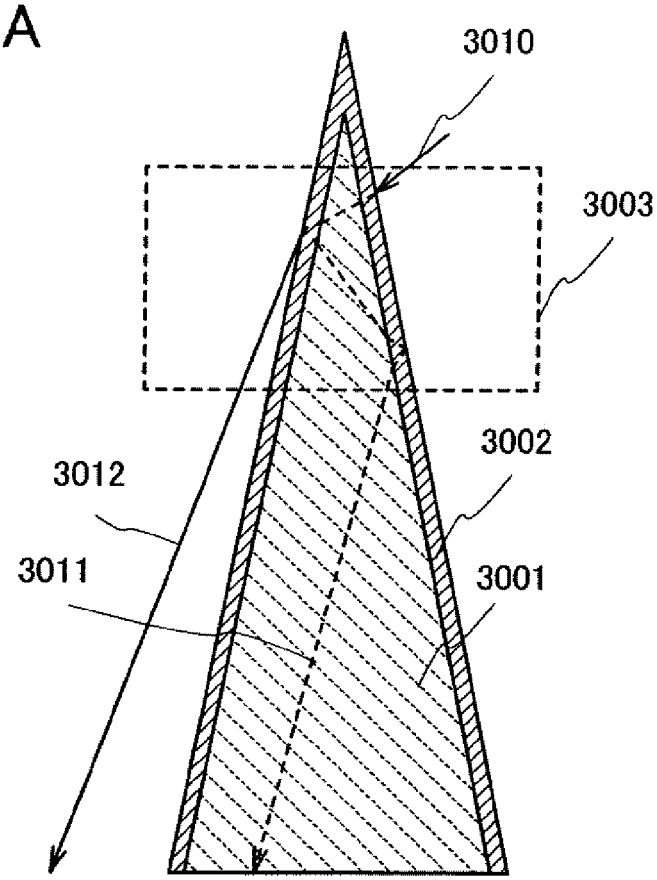
FIGS. 5A and 5B are cross-sectional-view diagrams illustrating conceptual diagrams of the present invention.
Figure 5B:
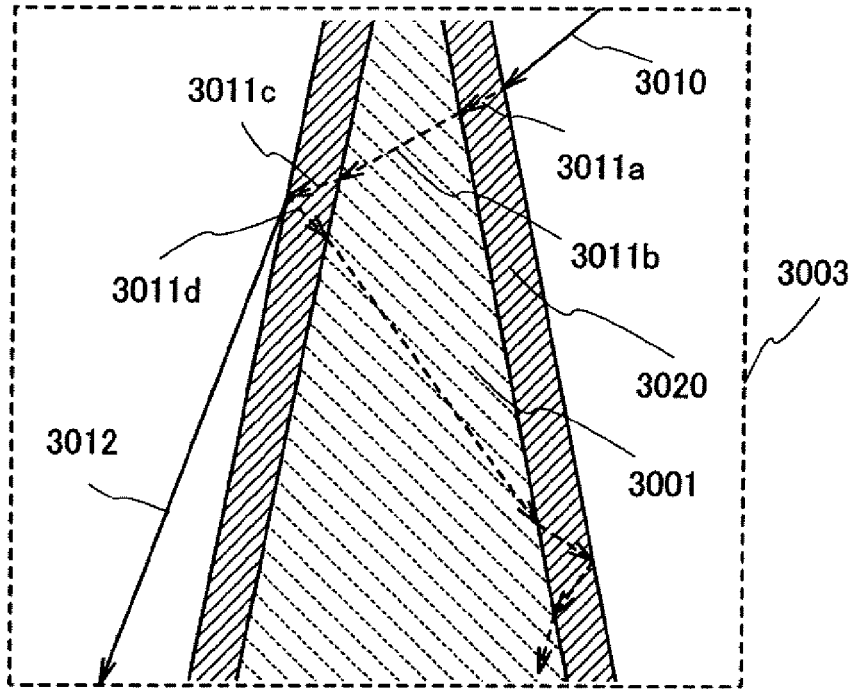

FIGS. 5A and 5B are models of an incident light ray 3010 from external that is incident on a pyramidal projection 3001 that is covered by a covering film 3002 to which the present invention is applied. The incident light ray 3010 from external becomes a light ray 3011, which propagates through the covering film 3002 and the pyramidal projection 3001, and a light ray 3012, which emerges from the covering film 3002 and the pyramidal projection 3001. An exploded-view diagram of a region 3003 in FIG. 5A is shown in FIG. 5B. In FIG. 5B, a light ray 3011*a*, which is a transmitted light ray of the incident light ray 3010 from external, is refracted at an interface between the atmosphere and the covering film 3002 and incident on the pyramidal projection 3001. The light ray 3011*a* becomes a refracted light ray 3011*b* that is refracted at the interface between the covering film 3002 and the pyramidal projection 3001. The light ray 3011*b* becomes a refracted light ray 3011*c* that is refracted at the interface between the covering film 3002 and the pyramidal projection 3001 and is incident on the interface between the covering film 3002 and the atmosphere. At this interface between the covering film 3002 and the atmosphere, a part of the light ray emerges from the covering film 3002 to external as the light ray 3012, which is a transmitted light ray, and the other part of the light ray is incident on the pyramidal projection 3001 as a reflected light ray 3011*d*.

It is to be noted that, even for light at the interface between the covering film and the atmosphere, one part is reflected as reflected light and the other part is transmitted as transmitted light.

Figure 25:
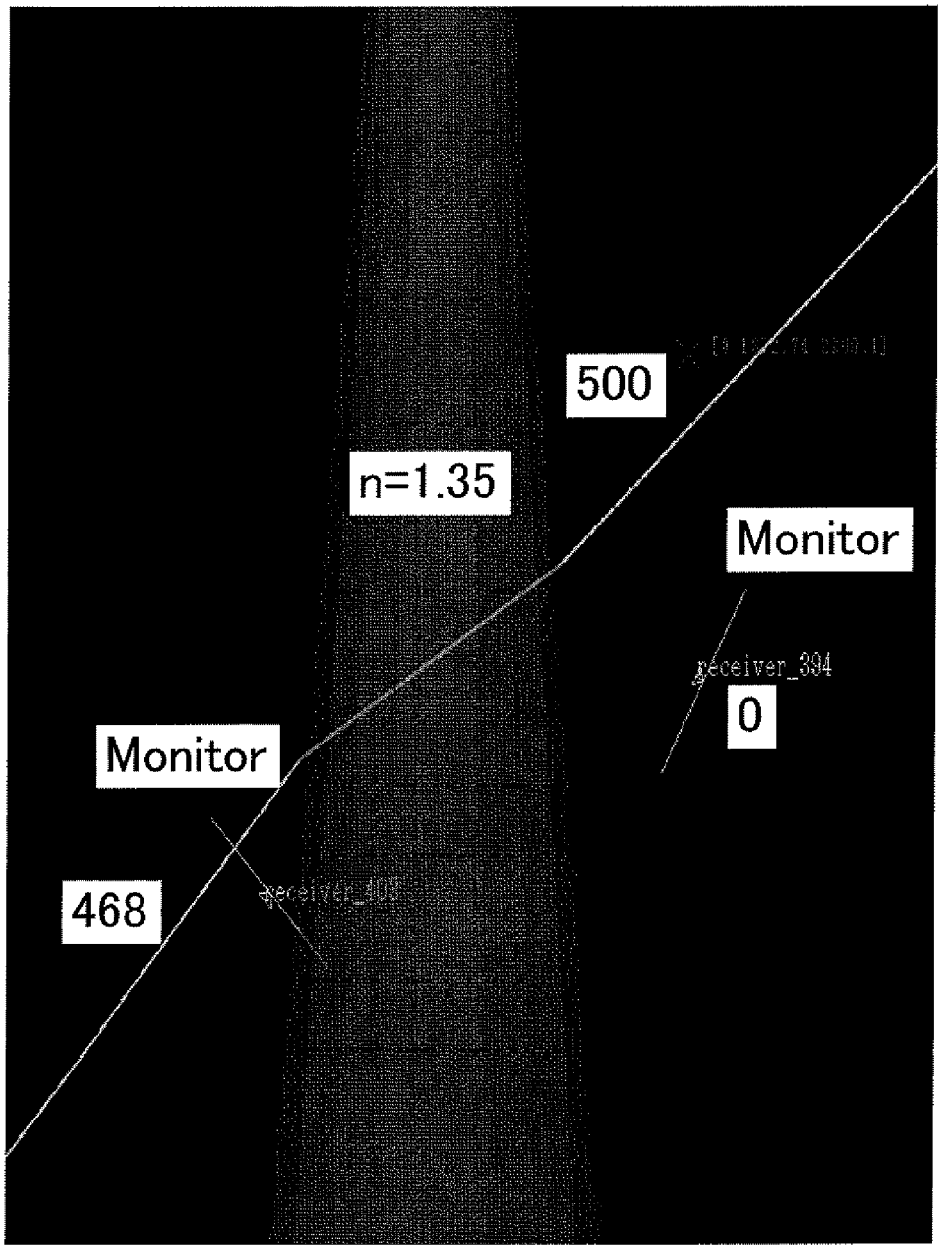
FIG. 25 is a graph showing experimental data for Embodiment Mode 1.
Figure 26:
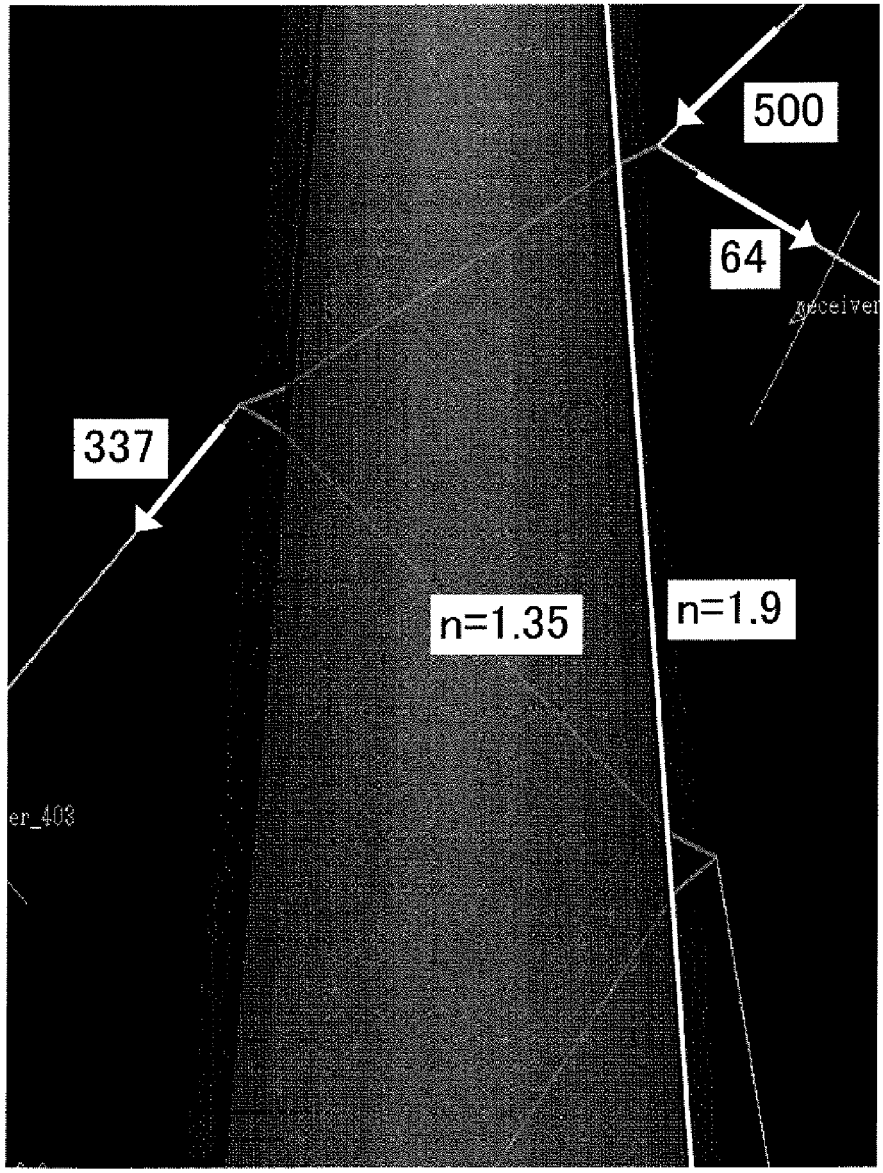
FIG. 26 is a graph showing experimental data for Embodiment Mode 1.

The results of optical calculations carried out for the model of the comparative example shown in FIG. 6 and for the model of the present embodiment mode that is shown in FIGS. 5A and 5B are given hereinafter. A monitor used to count the number of counts for the amount of light that is reflected at the surface of the pyramidal projection and the number of counts for the amount of light that emerges from the pyramidal projection is set up, and the amount of light that is confined within the pyramidal projection is calculated. In FIG. 25 and FIG. 26, results of a light ray tracking simulator LightTools (produced by Cybernet Systems, Co., LTD.) based on geometrical optics are shown. In FIG. 25, a comparative example of a pyramidal projection in which the index of refraction of a conical projection is 1.35 is shown. In FIG. 26, a pyramidal projection in which the conical projection that has an index of refraction of 1.35 is covered by a covering film that has an index of refraction of 1.9 is shown. The pyramidal projection in the comparative example has a height of 1500 nm and a width of 150 nm. For the model of FIG. 6 that uses the present invention, the height $H_1$ is 1500 nm and the width $L_1$ is 150 nm for the inner portion of the pyramidal projection; however, combined with the covering film portion, the height $H_2$ is 1540 nm and the width $L_2$ is 154 nm.

As in FIG. 25, with only the pyramidal projection, incident light (the number of counts of the amount of light is 500) enters the pyramidal projection. Because it is difficult for total reflection of all incident light to occur at the interface of the pyramidal projection, the light (the number of counts of the amount of light is 468) emerges from the pyramidal projection to external once again. In the plurality of the adjacent pyramidal projections, the light transmitted through the pyramidal projection that reaches the planar portion becomes, in the end, a potential cause of an increase in the amount of light reflected to the viewer side.

On the other hand, as in FIG. 26, at the surface of a pyramidal projection that has a covering film, for incident light (the number of counts of the amount of light is 500) that is reflected at the interface of the covering film, one part propagates through the pyramidal projection as transmitted light (the number of counts of the amount of light is 64); reflection into the pyramidal projection at the interface between the covering film and external occurs, and light (the number of counts of the amount of light is 337) emerges to external. Consequently, in the comparative example of FIG. 25, the number of counts for the amount of light confined within the pyramidal projection is 32 compared to 500 for the number of counts for the amount of incident light. In the structure that uses the present invention of FIG. 26, the number of counts for the amount of light confined within the pyramidal projection is 99, and it can be seen that a covering film formed of a material that has a high index of refraction has an effect of confining light to within the pyramidal projection.

Furthermore, in a structure that is the same as that of the comparative example of the pyramidal projection only (the height of the pyramidal projection being 750 nm and the width being 150 nm), when the index of refraction of the pyramidal projection is set to be 1.492 and the number of counts for the amount of incident light is set to be 10000, the number of counts for the amount of light that is transmitted through the pyramidal projection and emerges to external at the interface between external and the pyramidal projection is 5784. On the other hand, in a structure in which the pyramidal projection is covered by the covering film (with the height $H_1$ of 680 nm and the width $L_1$ of 136 nm of the pyramidal projection inner portion combined with that of the covering film portion, the height $H_2$ is 750 nm and the width $L_2$ is 150 nm), when the index of refraction for the covering film is set to be 1.9, the index of refraction for the pyramidal projection is set to be 1.492, and the number of counts for the amount of incident light is set to be 10000, the number of counts for the amount of light that emerges to external at the interface between external and the pyramidal projection is 4985. From this result, it is confirmed that, by covering of the pyramidal projection with a covering film that has a higher index of refraction than that of the pyramidal projection, there is an effect such that light is confined to within the pyramidal projection.

When light is incident on a material that has a low index of refraction from a material that has a high index of refraction, total reflection of all light occurs more readily when the difference in indices of refraction is high. By covering of the surface of the pyramidal projection 3001 with the covering film 3002 that has a high index of refraction, for light that emerges to external from the pyramidal projection 3001, the amount of light that is reflected within the pyramidal projection 3001 at an interface between the covering film 3002 and the atmosphere increases. Furthermore, by refraction of light at the interface between the covering film 3002 and the pyramidal projection 3001, the direction of propagation of light within the pyramidal projection 3001 comes to be nearly perpendicular to the base of the pyramidal projection, and because light is incident on the base (the display screen), the number of times light is reflected within the pyramidal projection 3001 is reduced. Consequently, by covering with the covering film 3002 that has a high index of reflection, there is an improvement in the effect in confinement of light to within the pyramidal projection 3001, and the reflection of light to external from the pyramidal projection 3001 can be reduced.

By covering of a surface of a pyramidal projection with a covering film that has a high index of refraction, because the reflection of light to external from the pyramidal projection can be prevented, even if there is a planar portion of a base (display screen) between adjacent pyramidal projections with a space between the adjacent pyramidal projections, the reflection of light to a viewer side by the planar portion can be prevented. Because the amount of reflection of incident light from external by the display screen to a viewer side can be reduced, the amount of freedom in selection of the shape of the pyramidal projections, the settings for arrangement, and manufacturing steps can be widened.

In addition, by stacked-layering of a pyramidal projection and a covering film, where there is a difference in indices of refraction therebetween, for light from the atmosphere that is incident on the covering film and the pyramidal projection, there is an effect in that the amount of reflected light is decreased due to the occurrence of optical interference between light reflected at an interface between the atmosphere and the covering film and light reflected at an interface between the covering film and the pyramidal projection.

It is preferable that the pyramidal projection be a shape that has a high number of sides such as a conical shape so that light can be dispersed effectively in a variety of directions, and the level of antireflective function can be increased.

Furthermore, by covering of the pyramidal projection with a covering film, physical strength of the pyramidal projection can be increased, and reliability is improved. By selection of a material for the covering film so that the covering film is made to be conductive, other useful functions can be provided, such as granting of an antistatic function and the like. For materials that can be used for the covering film, titanium oxide, which has a high light-transmitting property with respect to visible light and is also conductive; silicon nitride, silicon oxide, or aluminum oxide, of which physical strength is high; or aluminum nitride, silicon oxide, or the like, of which heat conductance is high can be used.

Figure 2A:
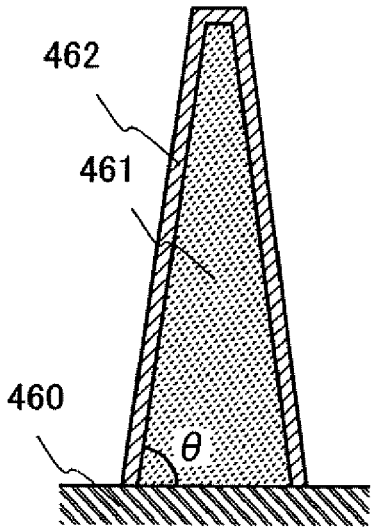
FIGS. 2A to 2C are conceptual diagrams of the present invention.
Figure 2B:
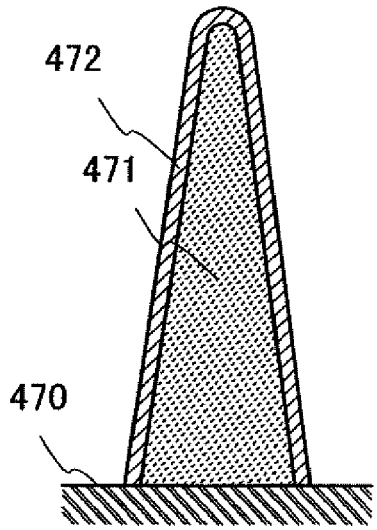
Figure 2C:
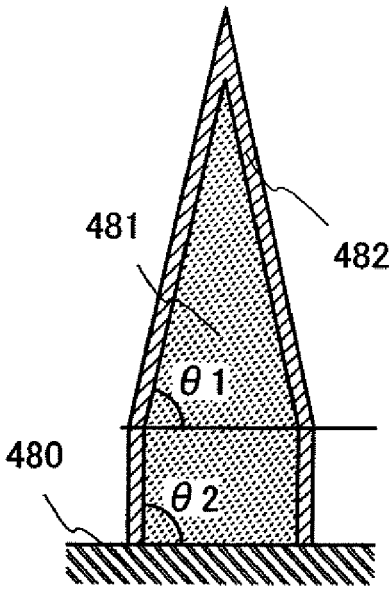

The pyramidal projection may have a conical shape, a polyhedral shape (triangular pyramid, square pyramid, pentagonal pyramid, hexagonal pyramid, and the like), or a needle shape; the tip of the pyramid may be flat where a cross section thereof is trapezoidal, a dome shape where the tip is rounded, or the like. Examples of shapes of the pyramidal projection are shown in FIGS. 2A to 2C. In FIG. 2A, a pyramidal projection 461 is formed over a substrate 460 that is to be used as a display screen and is covered with a covering film 462, and the pyramidal projection 461 that is covered with the covering film 462 does not have a shape in which the tip is pointed as with a conical shape but has a shape that has a top surface and a base surface. Thus, in a diagram of a cross section of a surface perpendicular to the base, the shape is a trapezoidal shape. In the present invention, the height of the pyramidal projection 461 from the lower base to the upper base is a height H.

FIG. 2B is an example in which a pyramidal projection 471 that has a round tip is formed over a substrate 470 that is to be used as a display screen and covered with a covering film 472. In this way, the pyramidal projection may be a shape that has a tip that has a rounded curvature, and in this case, the height H of the pyramidal projection is set to be the height from the base to the highest point of the tip.

FIG. 2C is an example in which a pyramidal projection 481, which has a plurality of angles $\theta_1$ and $\theta_2$ formed by a side with respect to the base of the pyramidal projection, is formed over a substrate 480 that is to be used as a display screen and covered with a covering film 482. In this way, the pyramidal projection may be a shape in which a conical figure (the angle between the side and the base is set to be $\theta_1$) is stacked over a columnar-shaped figure (the angle between the side and the base is set to be $\theta_2$). In this case, each of the angles $\theta_1$ and $\theta_2$ between a side and a base differs from the other such that $0° < \theta_1 < \theta_2$. For a pyramidal projection like the pyramidal projection 481 shown in FIG. 2C, the height H of the pyramidal projection is set to be the height of the portion where the side of the pyramidal projection is inclined.

FIGS. 3A1 and 3A2, 3B1 and 3B2, and 3C1 and 3C2 are examples of different shapes and arrangements of a plurality of pyramidal projections that are covered with covering films. FIGS. 3A2, 3B2, and 3C2 are top-view diagrams, FIG. 3A1 is a diagram of a cross section taken along line X1-Y1 in FIG. 3A2, FIG. 3B1 is a diagram of a cross section taken along line X2-Y2 in FIG. 3B2, and FIG. 3C1 is a diagram of a cross section taken along line X3-Y3 in FIG. 3C2.

FIGS. 3A1 and 3A2 show examples in which a plurality of pyramidal projections 466*a* to 466*c* are formed adjacent to each other with a defined space between adjacent pyramidal projections over a substrate 465 that is to be used as a display screen, and the pyramidal projections 466*a* to 466*c* are covered with covering films 467*a* to 467*c*. In this way, the pyramidal projections formed over the substrate 465 that is to be used as a display screen need not come into contact with each other. In the present invention, pyramidal projections formed in this way with a space between adjacent pyramidal projections are also referred to as an antireflective layer, which is a collective term used to refer to a portion that has an antireflective function. Thusly, such portions formed as film shapes are referred to as an antireflective layer even if the film shapes are not physically continuously formed together. The pyramidal projections 466*a* to 466*c* are examples of pyramidal projections that have a square pyramidal shape, the base of which is a square.

FIGS. 3B1 and 3B2 show examples in which a plurality of pyramidal projections 476*a* to 476*c* are formed adjacent to each other with an open space between the adjacent pyramidal projections over a substrate 475 that is to be used as a display screen, and the pyramidal projections 476*a* to 476*c* are covered with covering films 477*a* to 477*c*. The pyramidal projections 476*a* to 476*c* are examples of pyramidal projections that have a hexagonal pyramidal shape, the base of which is a hexagon.

FIGS. 3C1 and 3C2 show examples in which a plurality of pyramidal projections 486 are provided over a substrate 485 that is to be used as a display screen, and the plurality of pyramidal projections 486 are covered with covering films 487*a* to 487*c*. As shown in FIGS. 3C1 and 3C2, the structure may be set to be one in which the plurality of pyramidal projections 486 are formed of a single continuous film and provided over the top surface of a film (substrate).

The antireflective layer of the present invention may have a structure that has a plurality of pyramidal projections that are covered with a covering film. The pyramidal projections may be formed directly on the surface of a film (a substrate) as a single continuous structure; for example, the pyramidal projections may be formed such that the surface of the film (the substrate) is processed and the pyramidal projections are made, or the pyramidal projections may be formed such that shapes each having a pyramidal projection are formed as selected by a printing method such as nanoimprinting or the like. Alternatively, the pyramidal projections may be formed over the film (the substrate) by a different process, as well.

In FIGS. 7A to 7D, a specific example of a formation method of the pyramidal projections that are covered with a covering film is shown. The formation method shown in FIGS. 7A to 7D is a method that uses a nanoimprinting method, where a mold release film 3301 is formed in a mold 3300 that is formed into the shape of a pyramidal projection and a thin film 3302 that is to be used as a covering film is formed over the mold release film 3301. The mold release film 3301 is formed to transfer the thin film 3302 from the mold 3300 to a substrate 3303 (with reference to FIG. 7A). The thin film 3302 is bonded to the substrate 3303, and a thin film 3305 and a mold release film 3304, portions other than the pyramidal projections, are transferred to the substrate 3303 (with reference to FIG. 7B).

Figure 7A:
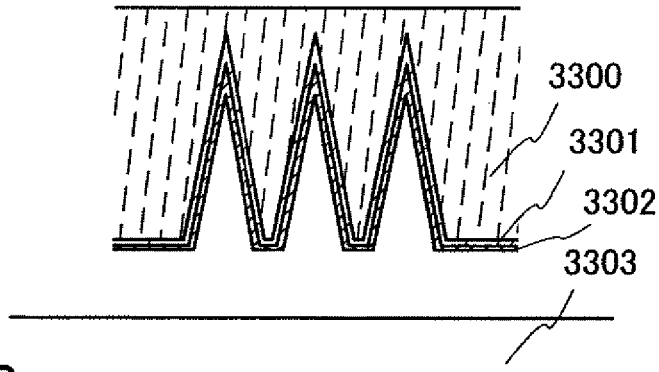
FIGS. 7A to 7D are diagrams illustrating a manufacturing method of a covering film and pyramidal projections of the present invention.
Figure 7B:
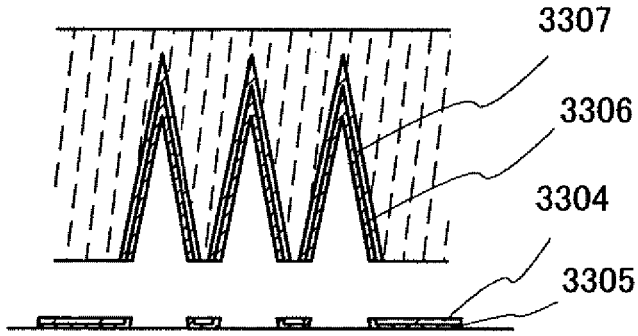
Figure 7C:
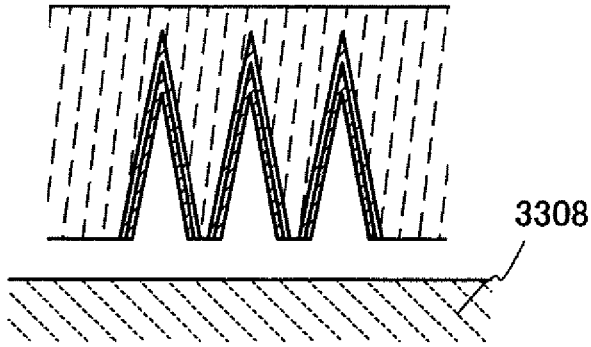
Figure 7D:
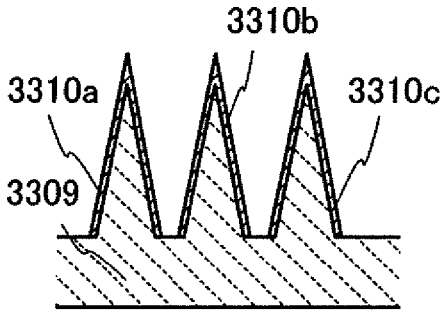

The mold 3300, a mold release film 3307, and a thin film 3306 are printed onto a layer 3308 of a pyramidal projection material used for imprinting, and pyramidal projections 3309 and covering films 3310*a*, 3310*b*, and 3310*c* are formed (with reference to FIGS. 7C and 7D). The thin film 3306 is separated from the mold 3300 by use of the mold release film 3307 and covers the pyramidal projections 3309 as the covering films 3310*a*, 3310*b*, and 3310*c*.

It is to be noted that the mold release film 3301 is not essential. When the thin film 3306 is formed of a material that can be easily separated from the mold 3300, a mold release film need not be formed.

The plurality of pyramidal projections may be formed as a single continuous film, or the plurality of pyramidal projections may be set to have a structure in which the plurality of pyramidal projections is formed over a substrate. Alternatively, the pyramidal projections may be made in the substrate in advance. For a substrate in which the pyramidal projections are formed, a glass substrate, a quartz substrate, or the like can be used. Furthermore, a flexible substrate may be used. A flexible substrate is a substrate that can be bent (is flexible). For example, in addition to a plastic substrate made from polyethylene terephthalate, polyethersulfone, polystyrene, polyethylene naphthalate, polycarbonate, polyimide, polyarylate, or the like, a macromolecular material elastomer like rubber that exhibits characteristics of an elastic body at room temperature and can be formed by the same kind of molding process as that used to form a plastic that is plasticized at high temperature and the like can be given. Furthermore, a film (polypropylene, polyester, vinyl, polyvinyl fluoride, vinyl chloride, polyamide, an inorganic deposition film, or the like) can be used, as well. The plurality of pyramidal projections may be made by processing of the substrate, or the plurality of pyramidal projections may be formed over the substrate by film formation or the like. Alternatively, the pyramidal projections may be formed by a different process and then attached to the substrate with an adhesive or the like. Even when the antireflective layer is provided over a different substrate that is to be used as a display screen, the antireflective layer can be provided by attachment to the substrate with a bonding agent, an adhesive, or the like. In this way, a variety of shapes that have a plurality of pyramidal projections can be applied to form the antireflective layer of the present invention.

For the covering film, a material with a higher index of refraction than that of the material used for the pyramidal projection, at least, should be used. Consequently, because the material used for the covering film is selected relatively based on the substrate forming the display screen of the PDP and FED and the material of the pyramidal projection formed over the substrate, the material used for the covering film can be set as appropriate.

In addition, the pyramidal projection can be formed of a material that does not have a uniform index of refraction but whose index of refraction changes from the apex of the pyramidal projection toward the substrate that is to be a display screen. The structure can be set to be one in which the plurality of pyramidal projections is formed of a material that has a index of refraction equivalent to that of the substrate as it approaches the substrate that is to be used as the display screen so that reflection of light propagating through each pyramidal projection and incident on the substrate is reduced at an interface between the pyramidal projection and the substrate.

The composition of a material used to form the pyramidal projections and the covering films may be set to be silicon, nitrogen, fluorine, an oxide, a nitride, a fluoride, or the like, as appropriate, based on the materials of the substrate used to form the surface of the display screen. For an oxide, silicon oxide, boric acid, sodium oxide, magnesium oxide, aluminum oxide (alumina), potassium oxide, calcium oxide, diarsenic trioxide (arsenic acid), strontium oxide, antimony oxide, barium oxide, indium tin oxide (ITO), zinc oxide, indium zinc oxide (IZO) of which zinc oxide is mixed into indium oxide, a conductive material of which silicon oxide is mixed into indium oxide, organic indium, organic tin, an indium oxide that contains tungsten oxide, an indium zinc oxide that contains tungsten oxide, an indium oxide that contains titanium oxide, an indium tin oxide that contains titanium oxide, or the like can be used. For a nitride, aluminum nitride, silicon nitride, or the like can be used. For a fluoride, lithium fluoride, sodium fluoride, magnesium fluoride, calcium fluoride, lanthanum fluoride, or the like can be used. The material can include one or a plurality of any of the aforementioned silicon, nitrogen, fluorine, oxides, nitrides, and fluorides, and the mixing ratio may be set, as appropriate, based on the component ratio (composition ratio) of each substrate.

After thin films are formed by a sputtering method, a vacuum deposition method, a physical vapor deposition (PVD) method, a chemical vapor deposition (CVD) method such as a low-pressure CVD (LPCVD) method or a plasma CVD method, the plurality of pyramidal projections and the covering film may be formed by the thin films being etched into desired shapes. Alternatively, in addition to a droplet discharge method by which a pattern can be formed selectively and a printing method (a method such as a screen printing method, offset printing, or the like by which a pattern is formed) by which a pattern can be transferred or rendered, a coating method such as a spin coating method or the like, a dipping method, a dispensing method, a brush application method, a spraying method, a flow-coat method, or the like can be used. Furthermore, imprinting technology or nanoimprinting technology by which a solid structure can be formed at the nanometer level by a transfer printing technique can also be used. Imprinting and nanoimprinting are technologies by which a detailed solid structure can be formed without use of any photolithography process.

In the present embodiment mode, a PDP and an FED with excellent visibility that each have an even higher level antireflective function by which the reflection of incident light from external can be reduced by provision of an antireflective layer that has a plurality of pyramidal projections covered with covering films over its surface, where each of the covering films has a higher index of refraction than that of the pyramidal projection, can be provided. Consequently, a PDP and an FED, each with even higher image quality and higher performance, can be manufactured.

Embodiment Mode 2

In the present embodiment mode, a PDP, the object of which is to have an antireflective function by which the reflection of incident light from external can be reduced even more and to provide a display device with excellent visibility, is described. That is, the details of a structure of a PDP that has a pair of substrates, at least one pair of electrodes provided between the pair of substrates, a phosphor layer provided between the pair of electrodes, and an antireflective layer provided on the outer side of one of the pair of substrates are given.

Figure 9:
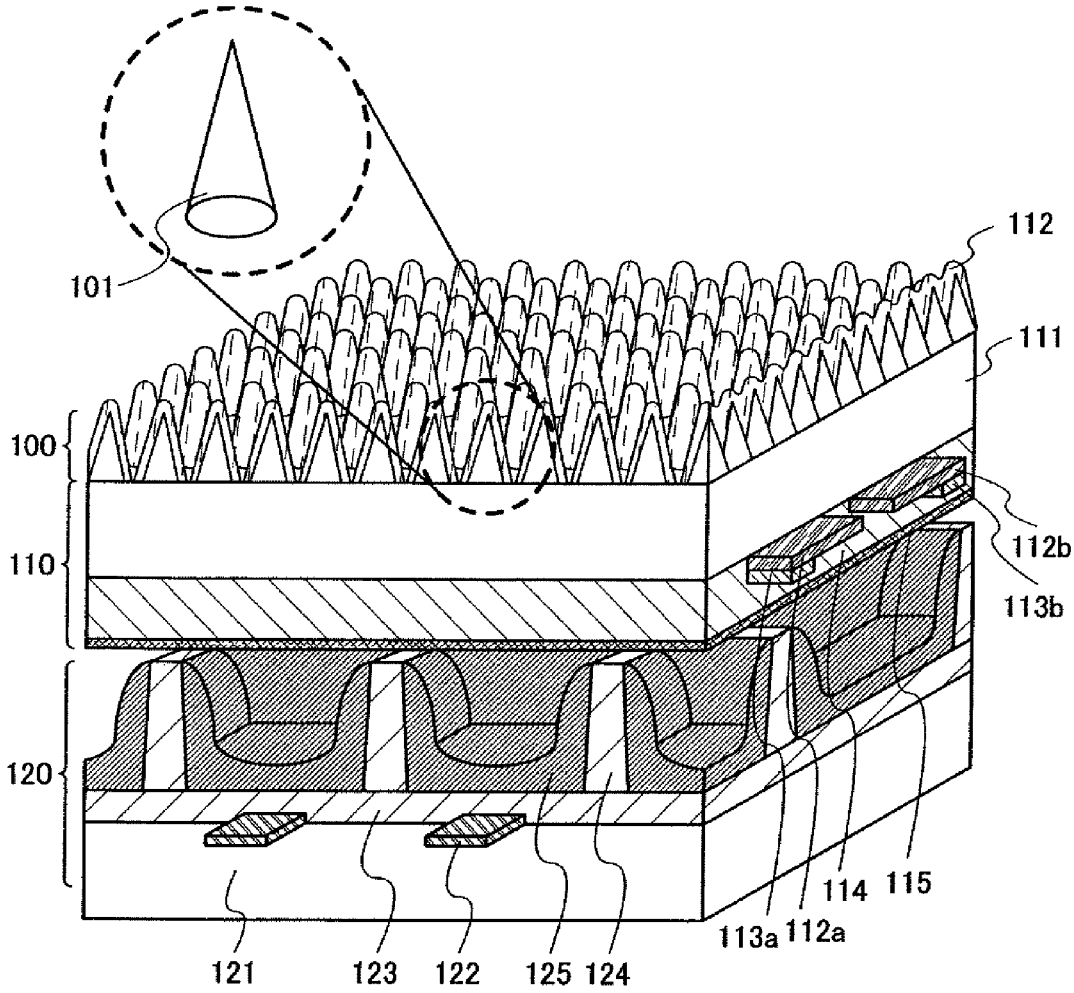
FIG. 9 is a perspective-view diagram illustrating a PDP of the present invention.

In the present embodiment mode, an alternating current discharge (AC type) surface emission PDP is given. As shown in FIG. 9, in the PDP, a front substrate 110 and a back substrate 120 are placed opposite from each other, and the periphery of the front substrate 110 and the back substrate 120 is sealed in with a sealant (which is not shown). Furthermore, areas between the front substrate 110, the back substrate 120, and the sealant are filled in with a discharge gas.

In addition, discharge cells of the display are arranged in matrix, and each discharge cell is located at an intersection of a display electrode contained in the front substrate 110 and a data electrode 122 contained in the back substrate 120.

In the front substrate 110, over one surface of a first light-transmitting substrate 111, a display electrode extending in a first direction is formed. The display electrode is made up of light-transmitting conductive layers 112*a* and 112*b*, a scan electrode 113*a*, and a sustain electrode 113*b*, Furthermore, a light-transmitting insulating layer 114 is formed to cover the first light-transmitting substrate 111, the light-transmitting conductive layers 112*a* and 112*b*, and the scan electrode 113*a* and the sustain electrode 113*b*. In addition, a protective layer 115 is formed over the light-transmitting insulating layer 114.

Moreover, over the other surface of the first light-transmitting substrate 111, an antireflective layer 100 is formed. The antireflective layer 100 has a pyramidal projection 101 and a covering film 112 that covers the pyramidal projection 101. For the pyramidal projection 101 and the covering film 112 covering the pyramidal projection 101 that are formed in the antireflective layer 100, the pyramidal projection and covering film that covers the pyramidal projection that are formed in the antireflective layer given in Embodiment Mode 1 can be used.

In the back substrate 120, over one surface of a second light-transmitting substrate 112, the data electrode 122 extending in a second direction that intersects with the first direction is formed. Furthermore, an inductive layer 123 is formed to cover the second light-transmitting substrate 121 and the data electrode 122. In addition, partition walls (ribs) 124 used to separate discharge cells are formed over the inductive layer 123. Moreover, a phosphor layer 125 is formed in a region bounded by the partition walls (ribs) 124 and the inductive layer 123.

Furthermore, a space enclosed by the phosphor layer 125 and the protective layer 115 is filled in with a discharge gas.

For the first light-transmitting substrate 111 and the second light-transmitting substrate 112, a glass substrate, a soda-lime glass substrate, or the like that has a high strain point and that can withstand a baking process at a temperature exceeding 500° C. can be used.

It is preferable that the light-transmitting conductive layers 112*a* and 112*b* that are formed over the first light-transmitting substrate 111 each have a light-transmitting property in order to transmit light from the phosphor, and thus, the light-transmitting conductive layers 112*a* and 112*b* are formed using ITO or tin oxide. Furthermore, the light-transmitting conductive layers 112*a* and 112*b* may be rectangular or T-shaped. After a conductive layer is formed over the first light-transmitting substrate 111 by a sputtering method, a coating method, or the like, the light-transmitting conductive layers 112*a* and 112*b* can be formed by etching of the conductive layer as selected. Moreover, the light-transmitting conductive layers 112*a* and 112*b* can be formed by coating by a droplet discharge method, a printing method, or the like and baking of a composite material as selected. Alternatively, the light-transmitting conductive layers 112*a* and 112*b* can be formed by a lift-off method.

It is preferable that the scan electrode 113*a* and the sustain electrode 113*b* be formed of a conductive layer that has a low resistance, and the scan electrode 113*a* and the sustain electrode 113*b* can be formed using chromium, copper, silver, aluminum, gold, or the like. Furthermore, a stacked-layer structure of copper, chromium, and copper or a stacked-layer structure of chromium, aluminum, and chromium can be used. For a formation method for the scan electrode 113*a* and the sustain electrode 113*b*, the same formation method that is used to form the light-transmitting conductive layers 112*a* and 112*b* can be used as appropriate.

The light-transmitting insulating layer 114 can be formed using glass with a low melting point that contains lead or zinc. For a formation method for the light-transmitting insulating layer 114, there is a printing method, a coating method, a green sheet laminating method, or the like.

The protective layer 115 is provided to protect the other layers from plasma discharge from the conductive layer and to promote emission of secondary electrons. For this reason, it is preferable that the protective layer 115 be formed using a material in which the ion sputtering rate is low, the number of secondary electrons emitted is high, the discharge starting voltage is low, and surface insulation is high. For a typical example of this kind of material, magnesium oxide is given. For a formation method for the protective layer 115, an electron beam evaporation method, a sputtering method, an ion plating method, a vapor deposition method, or the like can be used.

It is to be noted that a color filter and a black matrix may be provided in any one of the following: at the interface between the first light-transmitting substrate and the light-transmitting conductive layers 112*a* and 112*b*, at the interface between the light-transmitting conductive layers 112*a* and 112*b* and the light-transmitting insulating layer 114, within the light-transmitting insulating layer 114, at the interface between the light-transmitting insulating layer 114 and the protective layer 115, or the like. By provision of the color filter and the black matrix, the contrast between light and dark can be improved, and color purity of an emission color of a luminescent body can be improved. For the color filter, a colored layer of wavelength corresponding to the emission spectra of the light-emitting cell is provided.

For a material for the color filter, there is a material in which an inorganic pigment is dispersed throughout a glass with a low melting point that has a light-transmitting property, a colored glass in which a metal or a metal oxide is set to be the pigment composition, and the like. For an inorganic pigment, an iron oxide-based material (red), a chromium-based material (green), a vanadium-chromium-based material (green), a cobalt aluminate-based material (blue), and a vanadium-zirconium-based material (blue) can be used. Furthermore, for an inorganic pigment of the black matrix, a cobalt-chromium-iron-based material can be used. Moreover, in addition to the aforementioned inorganic pigments, inorganic pigments mixed together for the desired RGB color hues or black matrix color hue can be used.

The data electrode 122, the scan electrode 113*a*, and the sustain electrode 113*b* can be formed in the same way.

It is preferable that the color of the inductive layer 123 be set to be a highly reflective white color so that light emitted by the phosphor is extracted to the front substrate side effectively. The inductive layer 123 can be formed using a glass with a low melting point that contains lead; alumina; titania; or the like. For a formation method for the inductive layer 123, the same formation method used to form the light-transmitting insulating layer 114 can be used as appropriate.

The partition walls (ribs) 124 are formed using a glass with a low melting point that contains lead and using a ceramic. Because the partition walls (ribs) are crisscrossed, mixing of colors of light emitted by adjacent discharge cells can be prevented, and color purity can be improved. For a formation method for the partition walls (ribs) 124, a screen printing method, a sandblasting method, an additive method, a photosensitive paste method, a pressure molding method, or the like can be used. The partition walls (ribs) shown in FIG. 9 are crisscrossed, but they may instead be polygonal or circular, as well.

The phosphor layer 125 can be formed using different kinds of phosphor materials by which light can be emitted by irradiation of ultraviolet light. For example, for a blue phosphor material, there is $BaMgAl_{14}O_{23}$:Eu; for a red phosphor material, there is (Y, Ga)$BO_3$:Eu; and for a green phosphor material, there is $Zn_2SiO_4$:Mn. However, other phosphor materials can be used as appropriate. The phosphor layer 125 can be formed using a printing method, a dispensing method, a light adhesion method, a phosphor dry film method in which a dry film resist in which a phosphor powder is dispersed therethroughout is laminated over a phosphor, or the like can be used.

For the discharge gas, a gas mixture of neon and argon gases; a gas mixture of helium, neon, and xenon gases; a gas mixture of helium, xenon, and krypton gases; or the like can be used.

Next, a manufacturing method of a PDP is given hereinafter.

A sealing glass is printed over the periphery of the back substrate 120 by a printing method and temporarily baked. Next, the front substrate 110 and the back substrate 120 are aligned with each other and temporarily affixed to each other and heated. As a result, the sealing glass is melted and cooled, whereby the front substrate 110 and the back substrate 120 are affixed to each other so that a panel is formed. Then, while the panel is being heated, the atmosphere inside the panel is drawn down to a vacuum. Next, after a discharge gas is introduced into the panel from an air pipe formed in the back substrate 120, the air pipe formed in the back substrate 110 is heated, whereby the opening edge of the air pipe is closed off while the inside of the panel is sealed tight. Then, the cell of the panel is discharged, and discharge is continued and aging is performed until luminance characteristics and discharge characteristics are stable, whereby the panel is completed.

Figure 10A:
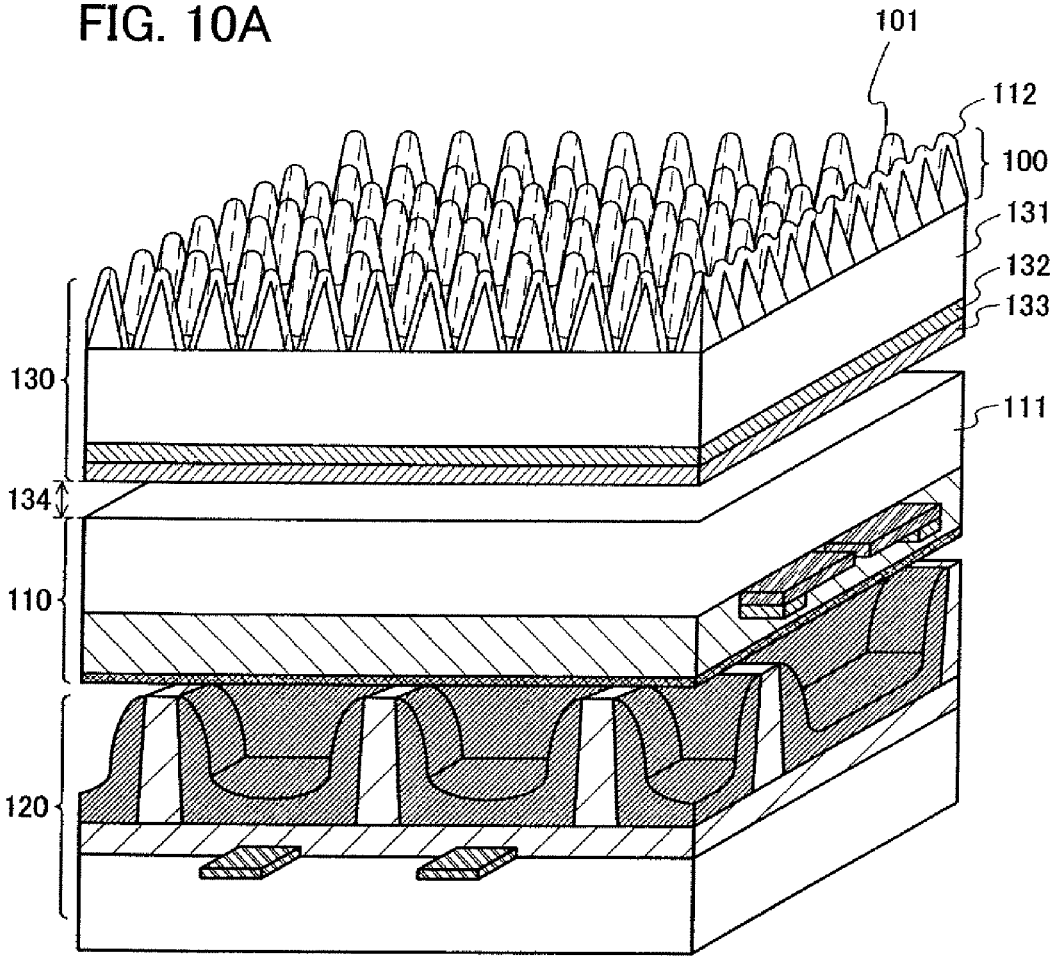
FIGS. 10A and 10B are perspective-view diagrams illustrating a PDP of the present invention.

Furthermore, for a PDP of the present embodiment mode, as shown in FIG. 10A, along with the sealed front substrate 110 and back substrate 120, an electromagnetic wave shield layer 133 and a near-infrared shielding layer 132 are formed over one surface of a light-transmitting substrate 131, and a color filter 130 may be provided over the reflective layer 100 that is formed, as shown in Embodiment Mode 1, over the other surface of the light-transmitting substrate 131. It is to be noted that, in FIG. 10A, a state is shown in which the antireflective layer 100 is not formed over the first light-transmitting substrate 111 of the front substrate 110; however, an antireflective layer may be formed over the first light-transmitting substrate 111 of the front substrate 110 as shown in Embodiment Mode 1, as well. By the structure being set to be this kind of structure, the reflectance of incident light from external can be reduced even more.

If a plasma is generated within the PDP, electromagnetic waves, infrared waves, and the like are discharged to the outer side of the PDP. The electromagnetic waves are harmful to the human body. Furthermore, infrared light is a cause of malfunction of a remote control. For this reason, it is preferable that an optical filter 130 be used in order to shield against electromagnetic waves and infrared light.

The antireflective layer 100 may be formed over the light-transmitting substrate 131 by the formation method given in Embodiment Mode 1. Alternatively, the antireflective layer 100 may be made in the surface of the light-transmitting substrate 131. Furthermore, the antireflective layer 100 may be attached to the light-transmitting substrate 131 by a UV-cured adhesive or the like.

For a representative example of the electromagnetic wave shield layer 133, there is a metal mesh, a metallic fiber mesh, a mesh in which an organic resin fiber is covered with a metal layer, and the like. The metal mesh and the metallic fiber mesh are formed by gold, silver, platinum, palladium, copper, titanium, chromium, molybdenum, nickel, zirconium, or the like. The metal mesh can be formed by an electroplating method, an electroless plating method, or the like after a resist mask is formed over the light-transmitting substrate 131. Alternatively, the metal mesh can be formed after a conductive layer is formed over the light-transmitting substrate 131 by etching of the conductive layer as selected by use of a resist mask formed by a photolithography process. Additionally, the metal mesh can be formed by use of a printing method, a droplet discharge method, or the like as appropriate. It is to be noted that it is preferable that the surface of each of the metal mesh, the metallic fiber mesh, the mesh in which a resin fiber is covered with a metal layer be treated with a black color in order to reduce the reflectance of visible light.

The organic resin fiber covered with a metal layer is formed of polyester, nylon, vinylidene chloride, aramid, vinylon, cellulose, or the like. Furthermore, the metal layer on the surface of the organic resin fiber is formed using any of the materials that are used for the metal mesh.

Moreover, for the electromagnetic wave shield layer 133, a light-transmitting conductive layer with a surface resistance of 10 Ω/cm$^2$ or less, more preferably, a surface resistance of 4 Ω/cm$^2$ or less, and even more preferably, a surface resistance of 2.5 Ω/cm$^2$ or less can be used. For the light-transmitting conductive layer, a light-transmitting conductive layer formed of ITO, tin oxide, zinc oxide, or the like can be used. It is preferable that the thickness of this light-transmitting conductive layer be greater than or equal to 100 nm and less than or equal to 5 μm, from a viewpoint of surface resistance and a light-transmitting property.

Furthermore, for the electromagnetic wave shield layer 133, a light-transmitting conductive film can be used. For the light-transmitting conductive film, a plastic film throughout which conductive particles are dispersed can be used. For the conductive particles, there are particles of carbon, gold, silver, platinum, palladium, copper, titanium, chromium, molybdenum, nickel, zirconium, and the like.

Figure 10B:
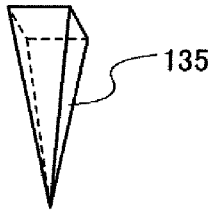

In addition, for the electromagnetic wave shield layer 133, a plurality of conical electromagnetic wave absorbers 135, as shown in FIG. 10B, may be provided. For an electromagnetic wave absorber, a polygonal pyramidal body such as a triangular pyramid, a square pyramid, a pentagonal pyramid, a hexagonal pyramid, or the like; a conical body; or the like can be used. Furthermore, a light-transmitting conductive layer of ITO or the like may be processed into a pyramidal shape. Additionally, after a pyramidal body is formed using the same materials as those used to form the light-transmitting conductive film, the pyramidal body may be formed over the surface of the light-transmitting conductive film. It is to be noted that absorption of electromagnetic waves can be increased by the angle of the apex of the electromagnetic wave absorber being oriented toward the first light-transmitting substrate 111 side.

It is to be noted that the electromagnetic wave shield layer 133 may be attached to the near-infrared light shielding layer 132 by an adhesive material such as an acrylic-based boding agent, a silicone-based adhesive, a urethane-based adhesive, or the like.

It is to be noted that the electromagnetic wave shield layer 133 is connected to earth ground by an edge.

The near-infrared light shielding layer 132 is a layer in which one or more kinds of pigments each having a maximum absorption wavelength of between 800 nm to 1000 nm are dissolved in an organic resin. For the above pigments, there are cyanine-based compounds, phthalocyanine-based compounds, naphthalocyanine-based compounds, anthrocene-based compounds, dithiol-based derivatives, and the like.

For an organic resin that can be used in the near-infrared light shielding layer 132, a polyester resin, a polyurethane resin, an acrylic resin, or the like can be used as appropriate. Furthermore, a solvent can be used as appropriate in order to dissolve the aforementioned pigments.

Moreover, for the near-infrared light shielding layer 132, a light-transmitting conductive layer of a copper-based material, a phthalocyanine-based compound, zinc oxide, silver, ITO, or the like or a nickel-derivative layer may be formed on the surface of the light-transmitting substrate 131. It is to be noted that when the near-infrared light shielding layer 132 is formed of the aforementioned materials, the film thickness is set to be a thickness at which the near-infrared light shielding layer 132 has a light-transmitting property and also shields against near-infrared light.

For a formation method for the near-infrared light shielding layer 132, formation can be performed by application of a composite material by a printing method, a coating method, or the like and then hardening by heat or by irradiation of light.

For the light-transmitting substrate 131, a glass substrate, a quartz substrate, or the like can be used. Furthermore, a flexible substrate may be used. A flexible substrate is a substrate that can be bent (is flexible). For example, a plastic substrate made from polyethylene terephthalate, polyethersulfone, polystyrene, polyethylene naphthalate, polycarbonate, polyimide, polyarylate, or the like can be given. Furthermore, a film (polypropylene, polyester, vinyl, polyvinyl fluoride, vinyl chloride, polyamide, an inorganic deposition film, or the like), can be used, as well.

Figure 11:
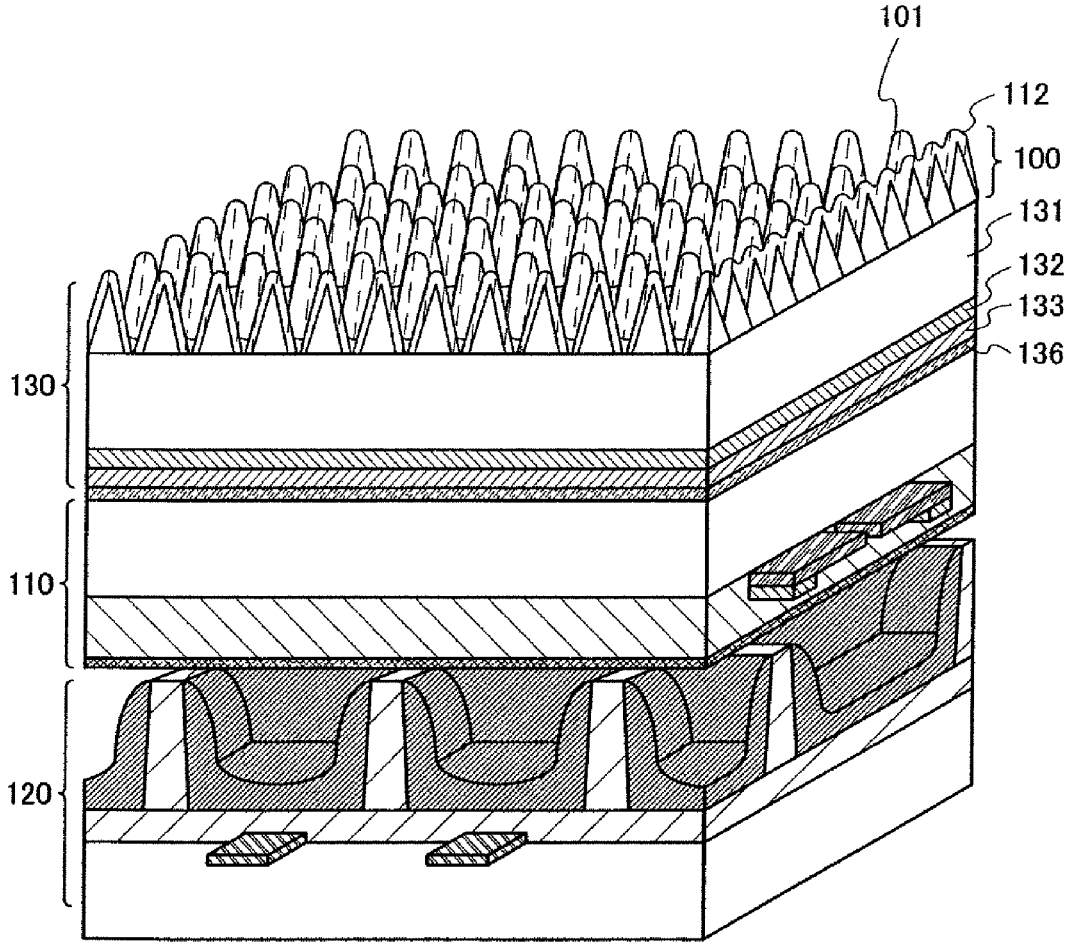
FIG. 11 is a perspective-view diagram illustrating a PDP of the present invention.

It is to be noted that, in FIG. 10A, the front substrate 110 and the optical filter 130 are placed with a gap 134 therebetween; however, the optical filter 130 and the front substrate 110 may be bonded together using an adhesive 136, as shown in FIG. 11. For the adhesive 136, a bonding agent that has a light-transmitting property may be used as appropriate. Typically, there are acrylic-based bonding agents, silicone-based adhesives, urethane-based adhesives, and the like.

In particular, when plastic is used in the light-transmitting substrate 131, by provision of the optical filter 130 on the surface of the front substrate 110 using the adhesive 136, the thickness and weight of a plasma display can be reduced.

It is to be noted that, here, the electromagnetic wave shield layer 133 and the near-infrared light shielding layer 132 are formed of different layers; however, the electromagnetic wave shield layer 133 and the near-infrared light shielding layer 132 may instead be formed as a single layer of a layer that has an electromagnetic wave shield function and a near-infrared light shielding function. By formation by a single layer, the thickness of the optical filter 130 can be reduced, and the thickness and weight of a PDP can be reduced.

Figure 12:
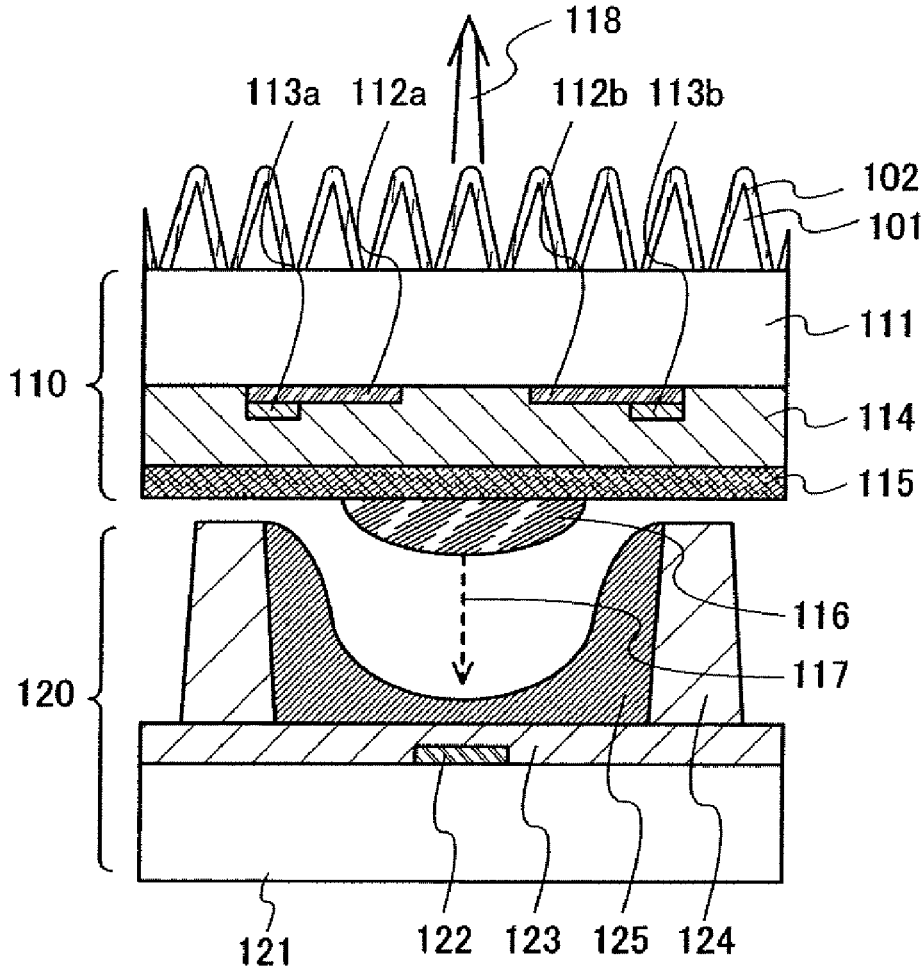
FIG. 12 is a cross-sectional-view diagram illustrating a PDP of the present invention.
Figure 13:
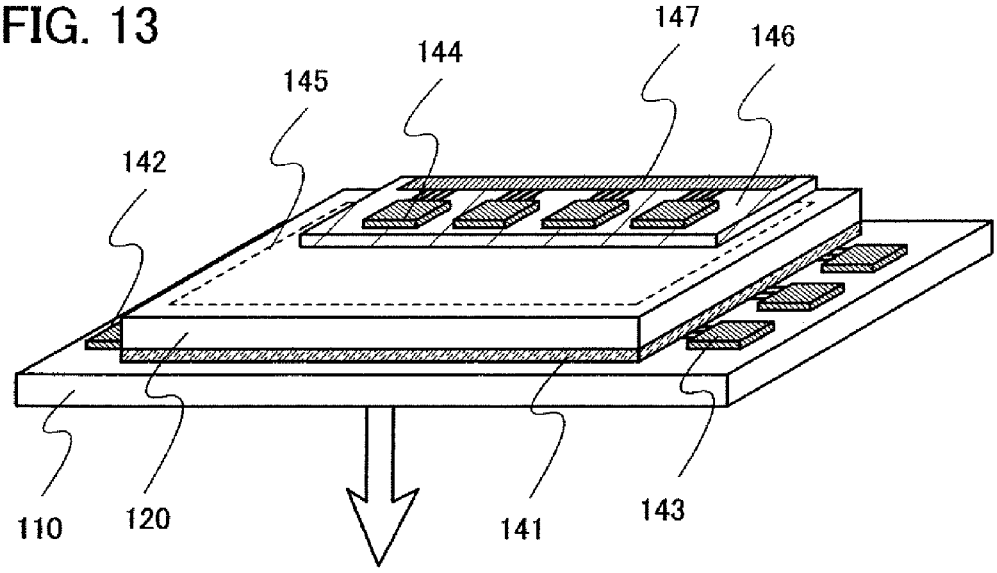
FIG. 13 is a perspective-view diagram illustrating a PDP module of the present invention.
Figure 14:
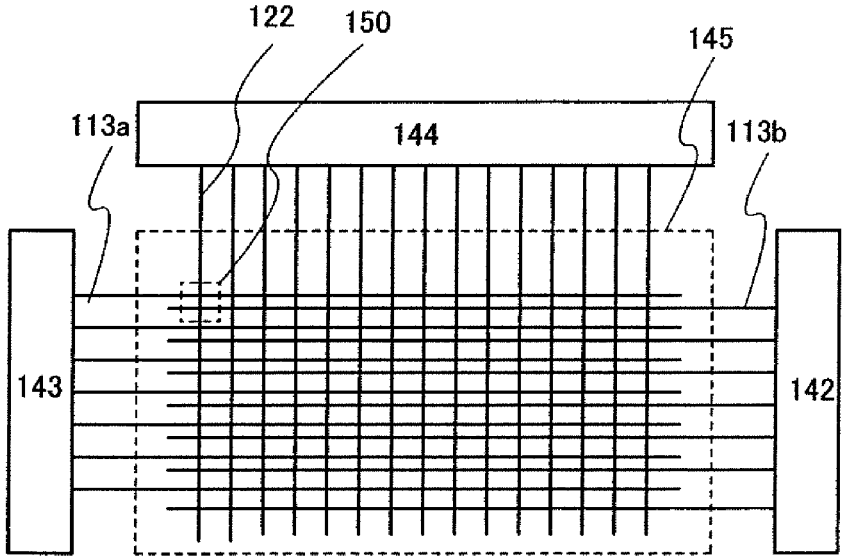
FIG. 14 is a diagram illustrating a PDP of the present invention.

Next, a PDP module and driving method thereof is described using FIG. 12, FIG. 13, and FIG. 14. FIG. 12 is a cross-sectional-view diagram of a discharge cell. FIG. 13 is a perspective-view diagram of a PDP module. FIG. 14 is a diagram of a representation of a PDP module.

As shown in FIG. 13, in the PDP module, the front substrate 110 and the back substrate 120 are sealed in by a sealing glass 141. Furthermore, in the first light-transmitting substrate, which is one part of the front substrate 110, a scan electrode driver circuit 142 that drives a scan electrode and a sustain electrode driver circuit 143 that drives a sustain electrode are provided and each connected to its respective electrode.

Moreover, in the second light-transmitting substrate, which is one part of the back substrate 120, a data electrode driver circuit 144 that drives a data electrode is provided and connected to the data electrode. Here, the data electrode driver circuit 144 is provided over a wiring board 146 and connected to the data electrode by an FPC 147. In addition, although not shown in the drawing, a controller circuit used to control the scan electrode driver circuit 142, the sustain electrode driver circuit 143, and the data electrode driver circuit 144 is provided over the first light-transmitting substrate 111 or over the second light-transmitting substrate 121.

As shown in FIG. 14, a discharge cell 150 of a display 145 is selected by a controller based on input image data, a pulse voltage greater than a discharge starting voltage is applied between the scan electrode 113*a* and the data electrode 122 in the selected discharge cell 150, and power is discharged between the electrodes. After discharging, by application of a pulse voltage between display electrodes (between the scan electrode 113*a* and the sustain electrode 113*b*) to maintain discharging, a plasma 116 is generated on the front substrate 110 side and discharging is maintained as shown in FIG. 12. In addition, ultraviolet light rays 117 generated from the discharge gas within the plasma irradiate the surface of the phosphor layer 125 of the back substrate and the phosphor layer 125 is excited, the phosphor is made to emit light, and emitted light 118 is emitted on the front substrate side.

It is to be noted that because there is no need for the sustain electrode 113*b* to scan within the display 145, the sustain electrode 113*b* can be set to be a common electrode. Furthermore, by setting of the sustain electrode 113*b* to be a common electrode, the number of driver ICs can be reduced.

In addition, in the present embodiment mode, an AC antireflective surface discharging PDP is given for the PDP; however, the type of PDP is not limited to this type. The antireflective layer 100 can be formed in an AC discharging type of transmission discharging PDP, as well. Furthermore, the antireflective layer 100 can be formed in a DC discharging PDP, as well.

The PDP of the present embodiment mode has an antireflective layer over its surface. The antireflective layer has a plurality of pyramidal projections over its surface. Because an interface between pyramidal projections is not perpendicular to the direction of incidence of incident light from external, reflected light of incident light from external is not reflected toward a viewer side but is reflected toward other, adjacent pyramidal projections. Part of the incident light enters an adjacent hexagonal pyramidal projection, and the rest of the incident light is incident on another adjacent pyramidal projection as reflected light. In this way, the incident light from external that is reflected at an interface between pyramidal projections is repeatedly incident on the other adjacent pyramidal projections.

That is, for the part of the incident light from external that is incident on the display screen of the PDP, because the number of times that the light is incident on the pyramidal projections increases, the amount of light transmitted through the pyramidal projection is increased. Consequently, the amount of the incident light from external that is reflected to the viewer side is reduced, and reflections and the like that cause reduction in visibility can be prevented.

When light is incident on a material that has a low index of refraction from a material that has a high index of refraction, total reflection of all light occurs more readily when the difference in indices of refraction is high. By covering of the surface of the pyramidal projection with a covering film that has a high index of refraction, for light that propagates toward external from the pyramidal projection, the amount of light that is reflected within the pyramidal projection at an interface between the covering film and the atmosphere increases. Furthermore, by refraction of light at the interface between the covering film and the pyramidal projection, the direction of propagation of light within the pyramidal projection comes to be nearly perpendicular to the base of the pyramidal projection, and because light is incident on the base (the display screen), the number of times light is reflected within the pyramidal projection is reduced. Consequently, by the pyramidal projection being covered with a covering film that has a high index of reflection, there is an improvement in the effect in confinement of light to within the pyramidal projection, and the reflection of light to external from the pyramidal projection can be reduced.

Because the reflection of light to an external surface of an antireflective layer that has the pyramidal projections can be prevented, even if there is a planar portion between adjacent pyramidal projections with a space between pyramidal projections, the reflection of light in the planar portion to a viewer side can be prevented. Because the amount of reflection of incident light from external by the planar portion to a viewer side can be reduced, the amount of freedom in selection of the shape of the pyramidal projections, the settings for arrangement, and manufacturing steps can be widened.

In addition, by stacked-layering of a pyramidal projection and a covering film, where there is a difference in indices of refraction therebetween, for light from the atmosphere that is incident on the covering film and the pyramidal projection, there is an effect in that the amount of reflected light is decreased due to the occurrence of optical interference between light reflected at an interface between the atmosphere and the covering film and light reflected at an interface between the covering film and the pyramidal projection.

In the present invention, when the difference between the index of refraction of the covering film and that of the pyramidal projection is high, it is preferable that the film thickness of the covering film be thin.

It is preferable that the pyramidal projection be a shape that has a high number of sides such as a conical shape so that light can be dispersed effectively in a variety of directions, and the level of antireflective function can be increased. Even if the structure is like with a conical shape where there exists a planar portion in-between pyramidal projections, because of the effect in which light is confined within the pyramidal projection by the covering film, the amount of light incident on the planar portion can be reduced, and reflection of light to a viewer side can be prevented.

The pyramidal projection may have a conical shape, a polyhedral shape (triangular pyramid, square pyramid, pentagonal pyramid, hexagonal pyramid, and the like), or a needle shape; the tip of the pyramid may be flat where a cross section thereof is trapezoidal, a dome shape where the tip is rounded, or the like.

Furthermore, by covering of the pyramidal projection with a covering film, physical strength of the pyramidal projection can be increased, and reliability is improved. By selection of a material for the covering film so that the covering film is made to be conductive, other useful functions can be provided, such as granting of an antistatic function and the like.

The PDP shown in the present embodiment mode has a high level antireflective function by which the reflection of incident light from external can be reduced by provision of an antireflective layer that has a pyramidal projection covered with a covering film, where the covering film has a higher index of refraction than that of the pyramidal projection. For this reason, a PDP with excellent visibility can be provided. Consequently, a PDP with even higher image quality and higher performance can be manufactured.

Embodiment Mode 3

In the present embodiment mode, an FED, the object of which is to have an antireflective function by which the reflection of incident light from external can be reduced even more and to provide a display device with excellent visibility, is described. That is, the details of a structure of an FED that has a pair of substrates, an electron emitter provided in one of the pair of substrates; an electrode provided in the other one of the pair of substrates; a phosphor layer provided in contact with the electrode; and an antireflective layer provided in the outer side of the other one of the pair of substrates are given.

An FED is a display device in which a phosphor is excited by an electron beam and emits light. FEDs can be separated into diode-type, triode-type, and tetrode-type according to electrode classification.

In a diode-type FED, a rectangular cathode electrode is formed over a surface of a first substrate, a rectangular anode electrode is formed over a surface of a second substrate, and the cathode electrode and anode electrode are orthogonal to each other through a distance of several micrometers to several millimeters. At a point of intersection through the vacuum space between the cathode electrode and the anode electrode, by application of a voltage of up to 10 kV, the electron beam is discharged between the electrodes. These electrons reach the phosphor layer associated with the cathode electrode and excite a phosphor that emits light, whereby an image is displayed.

In a triode-type FED, over a first substrate over which a cathode electrode is formed, a gate electrode that is orthogonal to the cathode electrode is formed with an insulating film interposed between the cathode electrode and the gate electrode. The cathode electrode and the gate electrode are in rectangular or matrix form, and an electron emitter is formed at the point where the cathode electrode and the gate electrode intersect with each other with the insulating film interposed therebetween. With application of a voltage between the cathode electrode and the gate electrode, an electron beam is emitted from the electron emitter. This electron beam is attracted to an anode electrode of a second substrate to which a voltage higher than that applied to the gate electrode is applied, a phosphor layer attached to the anode electrode is excited, and the phosphor layer emits light, whereby an image is displayed.

In a tetrode-type FED, a plate-shaped or thin film focusing electrode that has openings for each pixel is formed in-between the gate electrode and the anode electrode of a triode-type FED. An electron beam emitted from an electron emitter is focused for each pixel by the focusing electrode, a phosphor layer attached to the anode electrode is excited, and the phosphor layer emits light, whereby an image is displayed.

Figure 15:
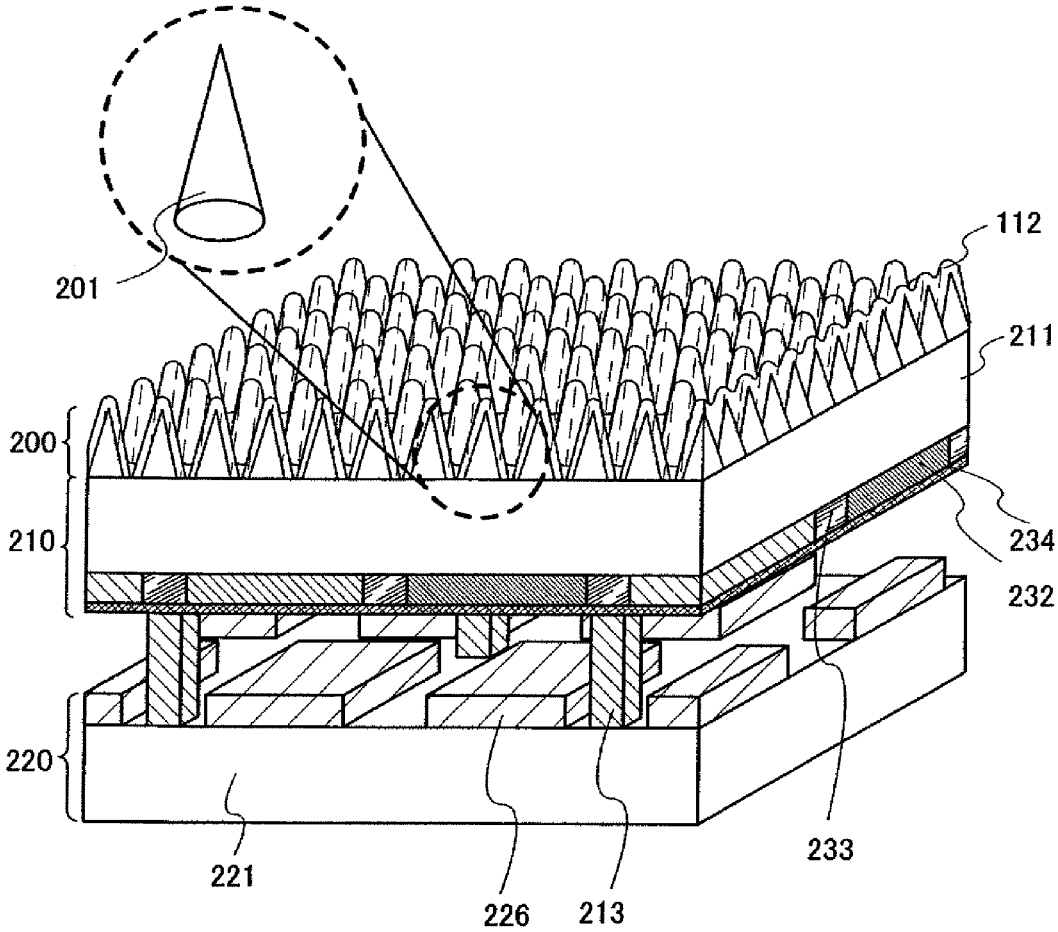
FIG. 15 is a perspective-view diagram illustrating an FED of the present invention.

In FIG. 15, a perspective diagram of an FED is given. As shown in FIG. 15, a front substrate 210 and a back substrate 220 are opposite from each other, and the periphery of the front substrate 210 and the back substrate 220 is sealed in with a sealant (which is not shown). Furthermore, a spacer 213 that is used to constantly maintain a space between the front substrate 210 and the back substrate 220 is provided between the front substrate 210 and the back substrate 220. In addition, the closed space of the front substrate 210, the back substrate 220, and a sealant is maintained at vacuum. Moreover, the electron beam moves within the closed space, a phosphor layer 232 that is attached to the anode electrode or to a metal backing is excited and made to emit light so that a given cell emits light, and a display image is obtained.

In addition, discharge cells of the display are arranged in matrix.

In the front substrate 210, the phosphor layer 232 is formed over one surface of the first light-transmitting substrate 211. Furthermore, a metal backing 234 is formed over the phosphor layer 232. It is to be noted that an anode may be formed in-between the first light-transmitting substrate 211 and the phosphor layer 232. For the anode, a rectangular conductive layer that extends in a first direction can be formed.

Moreover, over the other surface of the first light-transmitting substrate 211, an antireflective layer 200 is formed. The antireflective layer 200 has a projection 201. For the pyramidal projection 201 and the covering film 112 that covers the pyramidal projection 201 that are formed in the antireflective layer 200, the pyramidal projection and covering film given in Embodiment Mode 1 can be used.

In the back substrate 220, an electron emitter 226 is formed over one surface of a second light-transmitting substrate 221. For the electron emitter, a variety of structures can be proposed. Specifically, a Spindt electron emitter, a surface-conduction electron emitter, a ballistic electron surface emission electron emitter, a metal-insulator-metal (MIM) element, a carbon nanotube, a graphite nanofiber, diamond-like carbon (DLC), and the like can be given.

Figure 18A:
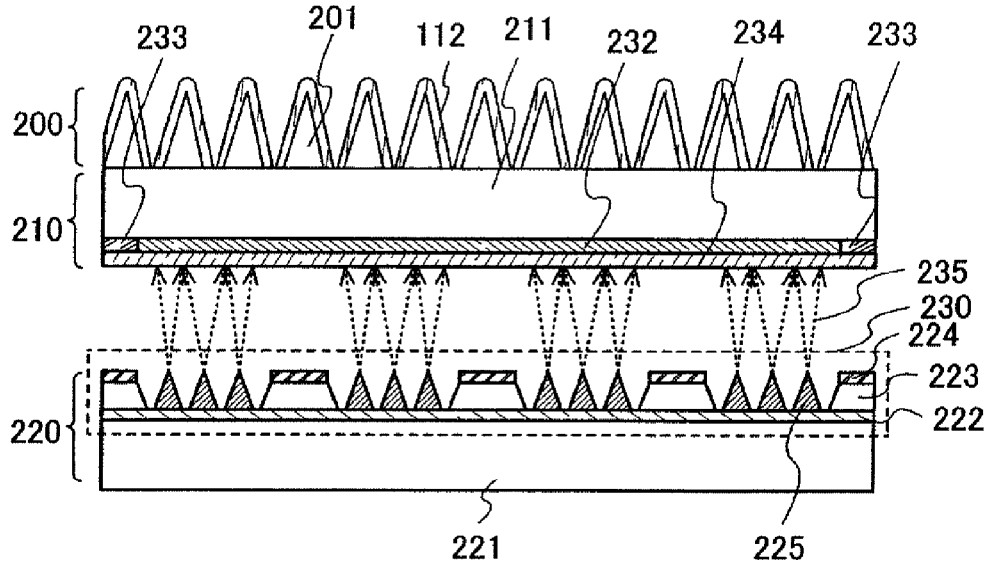
FIGS. 18A and 18B are cross-sectional-view diagrams illustrating an FED of the present invention.
Figure 18B:
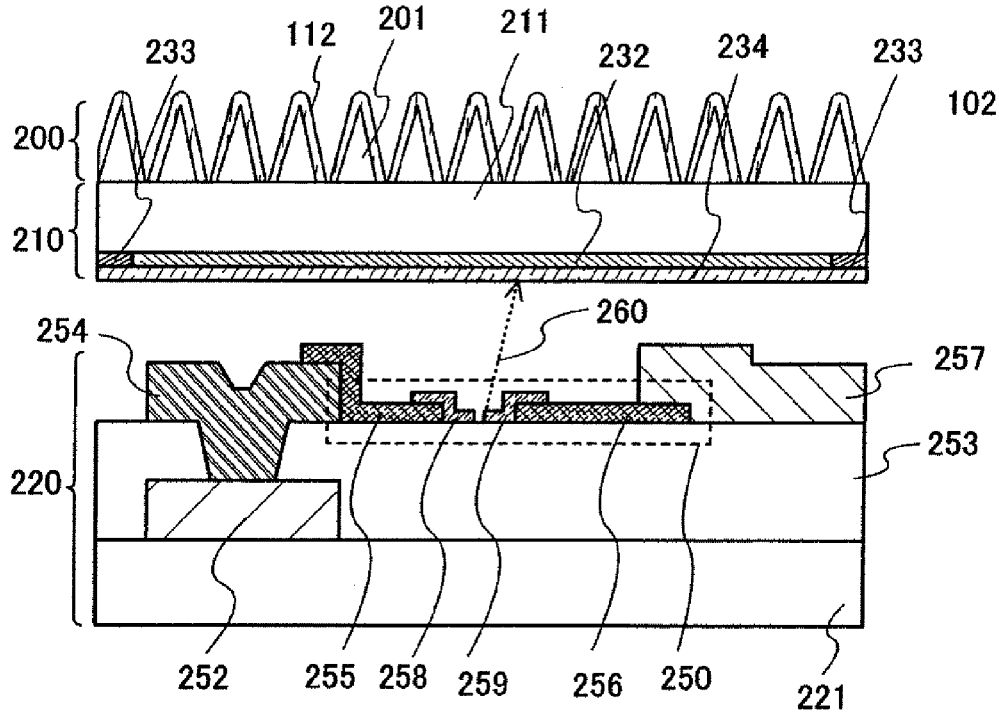

Here, a representative electron emitter is given using FIGS. 18A and 18B.

FIG. 18A is a cross-sectional-view diagram of a cell of an FED that has a Spindt electron emitter.

A Spindt electron emitter 230 is made up of a cathode electrode 222 and a conical-shaped electron source 225 that is formed over the cathode electrode 222. The conical-shaped electron source 225 is formed of a metal or a semiconductor. Furthermore, a gate electrode 224 is located in the periphery of the conical-shaped electron source 225. It is to be noted that the gate electrode 224 and the cathode electrode 222 are insulated by an interlayer insulating layer 223.

With application of a voltage between the gate electrode 224 and cathode electrode 222 formed in the back substrate 220, an electric field in the tip of the conical-shaped electron source 225 is concentrated to become a strong electric field, and electrons from the metal or the semiconductor forming the conical-shaped electron emitter 225 are emitted in vacuum by the tunneling phenomenon. At the same time, the metal backing 234 (or an anode electrode) and the phosphor layer 232 are formed in the front substrate 210. By application of a voltage to the metal backing 234 (or anode electrode), the electron beam 235 emitted from the electron source 225 is induced by the phosphor layer 232, the phosphor layer 232 is excited, and emission of light can be obtained. For this reason, the conical-shaped electron sources 225 that are enclosed by the gate electrodes 224 are arranged in matrix and a voltage is applied to the cathode electrode, the metal backing (or anode electrode), and the gate electrode as selected, whereby emission of light for each cell can be controlled.

Because a Spindt electron emitter has a structure in which the electric field strength is greatest in the central region of the gate electrode, extraction efficiency of electrons is high; moreover, advantages such as that a pattern for the arrangement of the electron emitter can be drawn accurately, the optimal arrangement for electron distribution is easy to set, in-plane conformity of lead-out current is high, and the like can be given.

Next, the structure of a cell that has a Spindt electron emitter is given. The front substrate 210 has the first light-transmitting substrate 211, the phosphor layer 232 and the black matrix 233 that are formed over the first light-transmitting substrate 211 as well as the metal backing 234 that is formed over the phosphor layer 232 and the black matrix 233.

For the first light-transmitting substrate 211, the same substrate as the first light-transmitting substrate 111 that is given in Embodiment Mode 2 can be used.

For the phosphor layer 232, a phosphor material that is excited by the electron beam 235 can be used. Furthermore, for the phosphor layer 232, phosphor layers of each of RGB are arranged in rectangular form, lattice form, and delta form, whereby color display can be obtained. Typically, $Y_2O_2S$:Eu (red), $Zn_2SiO_4$:Mn (green), and ZnS:Ag,Al (blue), or the like can be used. It is to be noted that, in addition to these materials, publicly known phosphor materials that are excited by an electron beam can be used.

Moreover, the black matrix 233 is provided between the phosphor layers 232. By provision of a black matrix, misalignment of emission colors due to misalignment of the place that is irradiated by the electron beam 235 can be prevented. Furthermore, by the black matrix 233 being made to be conductive, charging up of the phosphor layer 232 by the electron beam can be prevented. The black matrix 233 can be formed using carbon particles. It is to be noted that, in addition to carbon particles, publicly known black matrix materials for an FED can be used.

The phosphor layer 232 and the black matrix 233 can be formed using a slurry process or a printing method. A slurry process is a process where, after a composition in which the aforementioned phosphor materials or carbon particles are mixed into a photosensitive material, a solvent, or the like is applied by spin coating and then dried, exposure and development are performed.

The metal backing 234 can be formed using a conductive thin film of aluminum or the like that has a thickness of from 10 nm to 200 nm, inclusive, preferably, from 50 nm to 150 nm, inclusive. By formation of the metal backing 234, of the light emitted by the phosphor layer 232, light that travels through the back substrate 220 is reflected off the first light-transmitting substrate 211, and luminance can be improved. Furthermore, damage to the phosphor layer 232 from ion impacts occurring due to ionization of gas left remaining within the cell by the electron beam 235 can be prevented. Moreover, because the metal backing 234 fulfills the role of an anode with respect to the electron emitter 230, the metal backing 234 can make the electron beam 235 be induced by the phosphor layer 232. The metal backing 234 can be formed after a conductive layer has been formed by a sputtering method by etching of the conductive layer as selected.

The back substrate 220 is formed of the second light-transmitting substrate 221, the cathode electrode 222 that is formed over the second light-transmitting substrate 221, the conical-shaped electron source 225 that is formed over the cathode electrode 222, the interlayer insulating layer 223 that separates the electron sources 225 by cell, and the gate electrode 224 that is formed over the interlayer insulating layer 223.

For the second light-transmitting substrate 221, the same substrate as the second light-transmitting substrate 121 that is given in Embodiment Mode 2 can be used.

The cathode electrode 222 can be formed using tungsten, molybdenum, niobium, tantalum, titanium, chromium, aluminum, copper, or ITO. For a formation method for the cathode electrode 222, an electron beam evaporation method or a thermal deposition method can be used. Furthermore, a printing method, a plating method, or the like can be used. Alternatively, after a conductive layer is formed over the entire surface by a sputtering method, a CVD method, an ion plating method, or the like, the conductive layer is etched as selected using a resist mask or the like, whereby the cathode electrode 222 can be formed. If an anode electrode is formed, the cathode electrode can be formed of a rectangular conductive layer that extends in a first direction parallel to the direction in which the anode electrode extends.

The electron source 225 can be formed using tungsten, a tungsten alloy, molybdenum, a molybdenum alloy, niobium, a niobium alloy, tantalum, a tantalum alloy, titanium, a titanium alloy, chromium, a chromium alloy, silicon (that has been doped with phosphorus) that imparts n-type conductivity, or the like.

The interlayer insulating layer 223 is formed using the following: an inorganic siloxane polymer that contains an Si—O—Si bond from among compounds containing silicon, oxygen, and hydrogen formed using a siloxane polymer-based material as a starting material, which is typified by silica glass; or an organic siloxane polymer in which hydrogen bonded to silicon is substituted for by an organic group such as methyl or phenol, which is typified by an alkylsiloxane polymer, an alkylsilsesquioxane polymer, a silsesquioxane hydride polymer, or an alkylsilsesquioxane hydride polymer When the interlayer insulating layer 223 is formed using any of the above materials, a coating method, a printing method, or the like is used. Alternatively, a silicon oxide layer formed by a sputtering method, a CVD method, or the like may be formed for the interlayer insulating layer 223. It is to be noted that, in a region in which the electron source 225 is formed, an opening is formed in the interlayer insulating layer 223.

The gate electrode 224 can be formed using tungsten, molybdenum, niobium, tantalum, chromium, aluminum, copper, or the like. For a formation method for the gate electrode 224, the formation method used for the cathode electrode 222 can be used as appropriate. The gate electrode 224 can be formed of a rectangular conductive layer that extends in a second direction that intersects with the first direction at a 90° angle. It is to be noted that, in a region where the electron source 225 is formed, openings are formed in the gate electrode.

It is to be noted that a focusing electrode may be formed between the gate electrode 224 and the metal backing 234, that is, between the front substrate 210 and the back substrate 220. The focusing electrode is provided to focus an electron beam that is emitted from an electron emitter. By provision of a focusing electrode, improvement of the light emission luminance of a light-emitting cell, suppression of a reduction in contrast due to mixing of colors between adjacent cells, and the like can be achieved. It is preferable that a voltage of negative polarity compared to the metal backing (or the anode electrode) be applied to the focusing electrode.

Next, the structure of an FED cell that has a surface conduction electron emitter is given. FIG. 18B is a cross-sectional-view diagram of a cell of an FED that has a surface conduction electron emitter.

A surface conduction electron emitter 250 is made up of conductive layers 258 and 259 that each come into contact with one of opposite element electrodes 255 and 256 and one of element electrodes 255 and 256. The conductive layers 258 and 259 have gaps. If a voltage is applied to the element electrodes 255 and 256, a strong electric field is applied to the gaps, and electrons are emitted from one of the conductive layers to the other by a tunneling effect. By application of a positive voltage to the metal backing 234 (or anode electrode) formed in the front substrate 210, electrons emitted from one of the conductive layers to the other are induced by the phosphor layer 232. This electron beam 260 excites the phosphor, whereby emission of light can be obtained.

For this reason, the surface conduction electron emitters are arranged in matrix and a voltage is applied to the element electrodes 255 and 256 and the metal backing (or anode electrode) as selected, whereby emission of light for each cell can be controlled.

Because driving voltage for a surface conduction electron emitter is low compared to that of other electron emitters, a reduction in power consumption of the FED can be achieved.

Next, the structure of a cell that has a surface conduction electron emitter is given. The front substrate 210 has the first light-transmitting substrate 211, the phosphor layer 232 and the black matrix 233 that are formed over the first light-transmitting substrate 211, and the metal backing 234 that is formed over the phosphor layer 232 and the black matrix 233. It is to be noted that an anode may be formed in-between the first light-transmitting substrate 211 and the phosphor layer 232. For the anode, a rectangular conductive layer that extends in a first direction can be formed.

The back substrate 220 is formed of the second light-transmitting substrate 221, a column-direction wiring 252 that is formed over the second light-transmitting substrate 221, an interlayer insulating layer 253 that is formed over the column-direction wiring 252 and the second light-transmitting substrate 221, a connection wiring 254 that is connected to the column-direction wiring 252 via the interlayer insulating layer 253, the element electrode 255 that is connected to the connection wiring 254 and is formed over the interlayer insulating layer 253, the element electrode 256 that is formed over the interlayer insulating layer 253, a row-direction wiring 257 that is connected to the element electrode 256, the conductive layer 258 that is connected to the element electrode 255, and the conductive layer 259 that is connected to the element electrode 256. It is to be noted that the electron emitter 250 shown in FIG. 18B is made up of the element electrodes 255 and 256 that form a pair and the conductive layers 258 and 259 that form a pair.

The column-direction wiring 252 can be formed using a metal such as titanium, nickel, gold, silver, copper, aluminum, platinum, or the like or using an alloy of any of these metals. For a formation method for the column-direction wiring 252, a droplet discharge method, a vacuum deposition method, a printing method, or the like can be used. Furthermore, the column-direction wiring 252 can be formed by etching as selected of a conductive layer that has been formed by a sputtering method, a CVD method, or the like. It is preferable that the thickness of each of the element electrodes 255 and 256 be from 20 nm to 500 nm, inclusive.

For the interlayer insulating layer 253, the same materials and method used to form the interlayer insulating layer 223 shown in FIG. 18A can be used as appropriate. It is preferable that the thickness of the interlayer insulating layer 253 be from 500 nm to 5 μm, inclusive.

For the connection wiring 254, the same materials and method used to form the row-direction wiring 252 can be used as appropriate.

The element electrodes 255 and 256 that form a pair can be formed using a metal such as chromium, copper, iridium, molybdenum, palladium, platinum, titanium, tantalum, tungsten, zirconium, or the like or using an alloy of any of these metals. For a formation method for the element electrodes 255 and 256, a droplet discharge method, a vacuum deposition method, a printing method, or the like can be used. Furthermore, the column-direction wiring 252 can be formed by etching as selected of a conductive layer that has been formed by a sputtering method, a CVD method, or the like. It is preferable that the thickness of the element electrodes 255 and 256 be from 20 nm to 500 nm, inclusive.

For the column-direction wiring 257, the same materials and method used to form the row-direction wiring 252 can be used as appropriate.

A material for the conductive layers 258 and 259 that form a pair can be formed using, as appropriate, a metal such as palladium, platinum, chromium, titanium, copper, tantalum, tungsten, or the like; palladium oxide; tin oxide; a mixture of indium oxide and antimony oxide; silicon; carbon; or the like. Furthermore, each of the conductive layers 258 and 259 may be set to be a stacked-layer structure using a plurality of the above materials. Alternatively, each of the conductive layers 258 and 259 can be formed using particles of any of the above materials. It is to be noted that an oxide layer may be formed around the particles of the above material. By use of particles that have an oxide layer, the electrons can be accelerated and emitted easily. For a formation method for the conductive layers 258 and 259, a droplet discharge method, a vacuum deposition method, a printing method, or the like can be used. It is preferable that the thickness of each of the conductive layers 258 and 259 be from 0.1 nm to 50 nm, inclusive.

It is preferable that the width of a gap between the conductive layers 258 and 259 that form a pair be 100 nm or less, more preferable that the width be 50 nm or less. The gap can be formed by cleavage by application of a voltage between the conductive layers 258 and 259 or by cleavage using a focused ion beam. Furthermore, the gap can be formed by etching as selected by wet etching or dry etching using a resist mask.

It is to be noted that a focusing electrode may be formed between the front substrate 210 and the back substrate 220. An electron beam that is emitted from an electron emitter can be focused by the focusing electrode. By provision of a focusing electrode, improvement of the light emission luminance of a light-emitting cell, suppression of a reduction in contrast due to mixing of colors between adjacent cells, and the like can be achieved. It is preferable that a voltage of negative polarity compared to the metal backing 234 (or the anode electrode) be applied to the focusing electrode.

Next, a manufacturing method of an FED panel is given below.

A sealing glass is printed over the periphery of the back substrate 220 by a printing method and temporarily baked. Next, the front substrate 210 and the back substrate 220 are aligned with each other and temporarily affixed to each other and heated. As a result, the sealing glass is melted and cooled, whereby the front substrate 210 and the back substrate 220 are affixed to each other so that a panel is formed. Then, while the panel is being heated, the atmosphere inside the panel is drawn down to a vacuum. Next, the air pipe formed in the back substrate 210 is heated, whereby the opening edge of the air pipe is closed off while the inside of the panel is vacuum-sealed, and the FED panel is completed.

Figure 16:
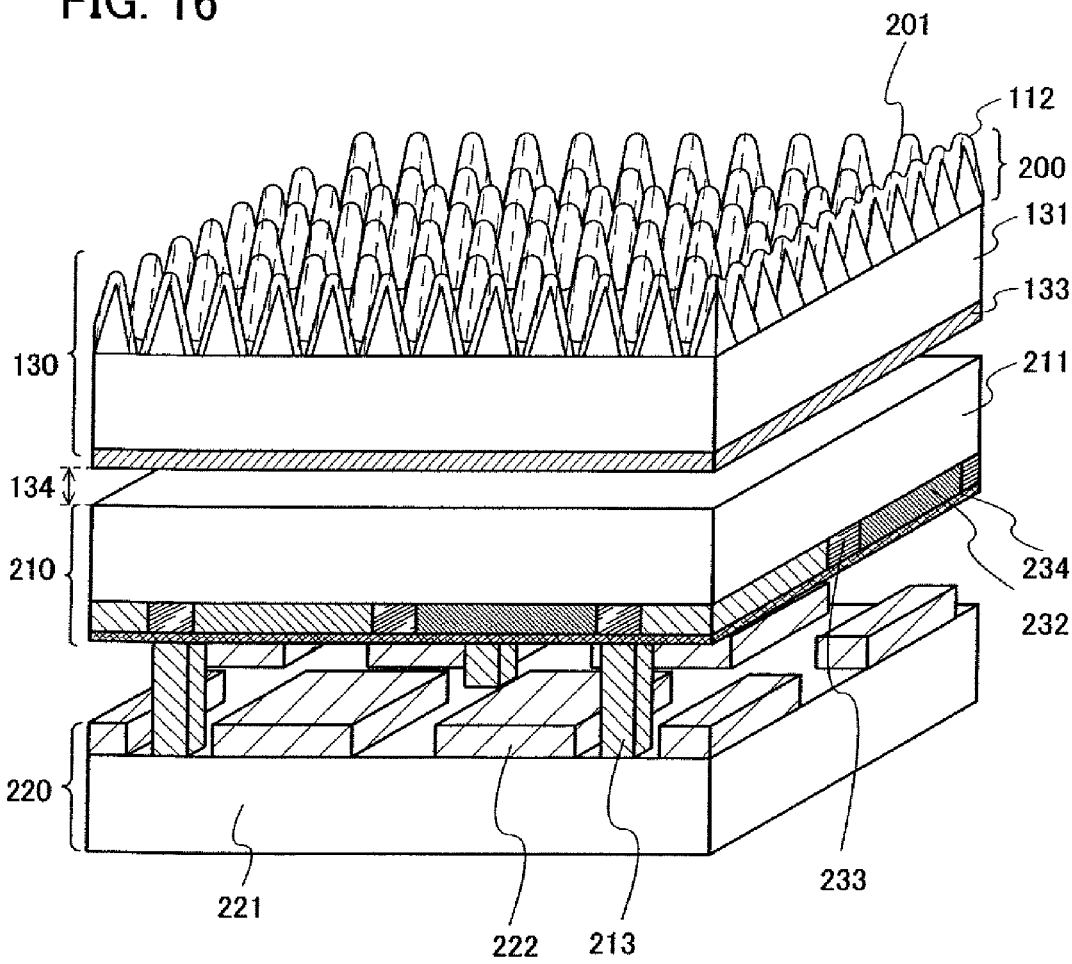
FIG. 16 is a perspective-view diagram illustrating an FED of the present invention.

Furthermore, for an FED, as shown in FIG. 16, along with a panel in which the front substrate 210 and back substrate 220 are sealed up, an electromagnetic wave shield layer 133 like the one shown in Embodiment Mode 2 is formed over one surface of a light-transmitting substrate 131, and a color filter 130 formed of the reflective layer 200 may be provided over the other surface of the light-transmitting substrate 131 as shown in Embodiment Mode 1. It is to be noted that, in FIG. 16, a state is shown in which the antireflective layer 200 is not formed over the first light-transmitting substrate 211 of the front substrate 210; however, an antireflective layer may be formed over the first light-transmitting substrate 211 of the front substrate 210 as shown in Embodiment Mode 1, as well. By the structure being set to be this kind of structure, the reflectance of incident light from external can be reduced even more.

Figure 17:
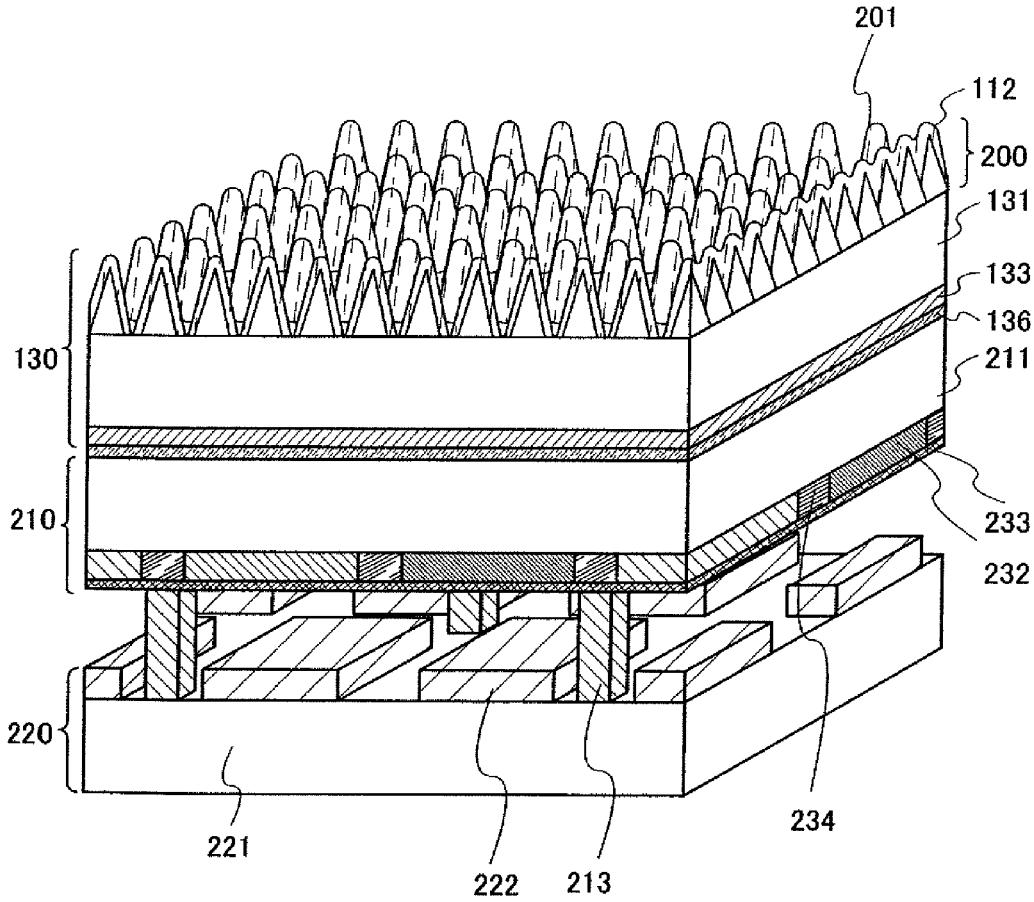
FIG. 17 is a perspective-view diagram illustrating an FED of the present invention.

It is to be noted that, in FIG. 16, the front substrate 210 and the optical filter 130 are arranged with a gap 134 therebetween; however, the optical filter 130 and the front substrate 210 may be bonded together using an adhesive 136, as shown in FIG. 17.

In particular, when plastic is used in the light-transmitting substrate 131, by provision of the optical filter 130 on the surface of the front substrate 210 using the adhesive 136, the thickness and weight of an FED can be reduced.

It is to be noted that, here, a structure that has the electromagnetic wave shield layer 133 and the antireflective layer 200 in the optical filter 130 is shown; however, a near-infrared light shielding layer may be formed along with the electromagnetic wave shield layer 133 as shown in Embodiment Mode 2. Furthermore, a functional layer that has an electromagnetic wave shielding function and a near-infrared light shielding function may be formed as one layer.

Figure 19:
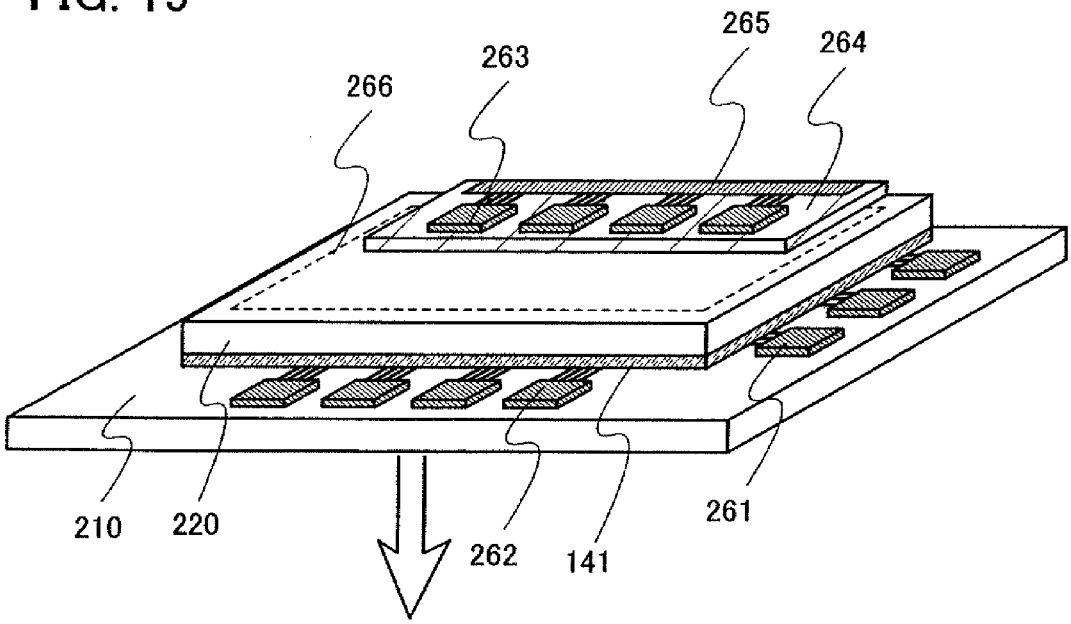
FIG. 19 is a perspective-view diagram illustrating an FED module of the present invention.
Figure 20:
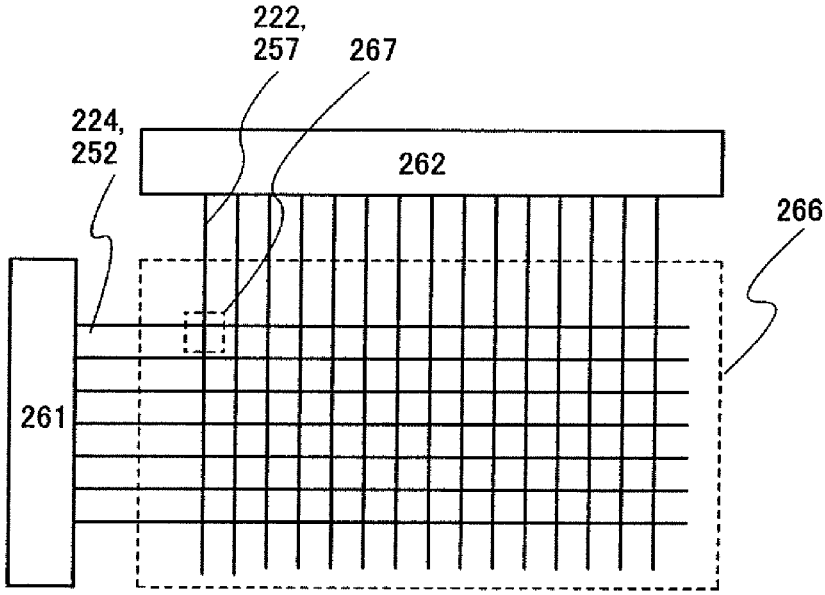
FIG. 20 is a diagram illustrating an FED of the present invention.

Next, an FED module that has a Spindt electron emitter and a driving method thereof are described using FIG. 18A, FIG. 19, and FIG. 20. FIG. 19 is a perspective-view diagram of the FED module, and FIG. 20 is a diagram of a representation of the FED module.

As shown in FIG. 19, the periphery of the front substrate 210 and the back substrate 220 is sealed in by a sealing glass 141. Furthermore, in the first light-transmitting substrate, which is one part of the front substrate 210, a driver circuit 261 that drives a row electrode and a driver circuit 262 that drives a column electrode are provided and each connected to its respective electrode.

Moreover, in the second light-transmitting substrate that is one part of the back substrate 220, a driver circuit 263 used to apply a voltage to the metal backing (or to the anode electrode) is provided and connected to the metal backing (or to the anode electrode). Here, the driver circuit 263 that is used to apply a voltage to the metal backing (or to the anode electrode) is formed over a wiring board 264, and the driver circuit 263 and the metal backing (or the anode electrode) are connected to each other by an FPC. In addition, although not shown in the drawings, a control circuit used to control the driver circuits 261 to 263 is formed over the first light-transmitting substrate 211 or over the second light-transmitting substrate 221.

As shown in FIG. 18A and FIG. 20, a light-emitting cell 267 of a display 266 is selected by the driver circuit 261 that is used to drive the row electrode and by the driver circuit 262 that is used to drive the column electrode based on image data input from a controller, a voltage is applied to the gate electrode 224 and the cathode electrode 222 in the light-emitting cell 267, and an electron beam is emitted from the electron emitter 230 of the light-emitting cell 267. In addition, an anode voltage is applied to the metal backing 234 (or to the anode electrode) by the driver circuit that is used to apply a voltage to the metal backing 234 (or to the anode electrode). The electron beam 235 emitted from the electron emitter 230 of the light-emitting cell 267 is accelerated by the anode voltage; the surface of the phosphor layer 232 of the front substrate 210 is irradiated by the electron beam 235, whereby the phosphor layer 232 is excited; the phosphor is made to emit light; and the emitted light can be emitted to the outer side of the front substrate. Furthermore, by selection of a given cell by the aforementioned method, display of an image can be obtained.

Next, an FED module that has a surface emission electron emitter and a driving method thereof are described using FIG. 18B, FIG. 19, and FIG. 20.

As shown in FIG. 19, the periphery of the front substrate 210 and the back substrate 220 is sealed in by a sealing glass 141. Furthermore, in the first light-transmitting substrate, which is one part of the front substrate 210, the driver circuit 261 that drives a row electrode and the driver circuit 262 that drives a column electrode are provided and each connected to its respective electrode.

Moreover, in the second light-transmitting substrate that is one part of the back substrate 220, a driver circuit 263 used to apply a voltage to the metal backing (or to the anode electrode) is provided and connected to the metal backing (or to the anode electrode). In addition, although not shown in the drawings, a control circuit used to control the driver circuits 261 to 263 is formed over the first light-transmitting substrate or over the second light-transmitting substrate.

As shown in FIG. 18B and FIG. 20, a light-emitting cell 267 of a display 266 is selected by the driver circuit 261 that is used to drive the row electrode and by the driver circuit 262 that is used to drive the column electrode based on image data input from a controller, a voltage is applied to a column-direction wiring 252 and a row-direction wiring 257 in the light-emitting cell 267, a voltage is applied between the element electrodes 255 and 256, and an electron beam 260 is emitted from the electron emitter 250 of the light-emitting cell 267. In addition, an anode voltage is applied to the metal backing 234 (or to the anode electrode) by the driver circuit that is used to apply a voltage to the metal backing 234 (or to the anode electrode). The electron beam 260 emitted from the electron emitter 250 is accelerated by the anode voltage; the surface of the phosphor layer 232 of the front substrate 210 is irradiated by the electron beam 250, whereby the phosphor layer 232 is excited; the phosphor is made to emit light; and the emitted light can be emitted to the outer side of the front substrate. Furthermore, by selection of a given cell by the aforementioned method, display of an image can be obtained.

The FED of the present embodiment mode has an antireflective layer over its surface. The antireflective layer has a plurality of pyramidal projections. Because an interface between pyramidal projections is not perpendicular to the direction of incidence of incident light from external, reflected light of incident light from external is not reflected toward a viewer side but is reflected toward other, adjacent pyramidal projections. Part of the incident light is incident on an adjacent hexagonal pyramidal projection, and the rest of the incident light is incident on another adjacent pyramidal projection as reflected light In this way, the incident light from external that is reflected at an interface between pyramidal projections is repeatedly incident on the other adjacent pyramidal projections.

That is, for the part of the incident light from external that is incident on the FED, because the number of times the light is incident on the pyramidal projections increases, the amount of light transmitted through the pyramidal projection is increased. Consequently, the amount of the incident light from external that is reflected to the viewer side is reduced, and reflections and the like that cause reduction in visibility can be prevented.

When light is incident on a material that has a low index of refraction from a material that has a high index of refraction, total reflection of all light occurs more readily when the difference in indices of refraction is high. By covering of the surface of the pyramidal projection with a covering film that has a high index of refraction, for light that propagates toward external from the pyramidal projection, the amount of light that is reflected within the pyramidal projection at an interface between the covering film and the atmosphere increases. Furthermore, by refraction of light at the interface between the covering film and the pyramidal projection, the direction of propagation of light within the pyramidal projection comes to be nearly perpendicular to the base of the pyramidal projection, and because light is incident on the base (the display screen), the number of times light is reflected within the pyramidal projection is reduced. Consequently, by the pyramidal projection being covered with a covering film that has a high index of reflection, there is an improvement in the effect in confinement of light to within the pyramidal projection, and the reflection of light to external from the pyramidal projection can be reduced.

Because the reflection of light to external from the pyramidal projection can be prevented, even if there is a planar portion between adjacent pyramidal projections with a space between adjacent pyramidal projections, the reflection of light to a viewer side by the planar portion can be prevented. That is to say, even if there is some space between at least one side that forms the base of the pyramid of one of the pyramidal projections and a side that forms the base of the pyramid of an adjacent pyramidal projection, the reflection of light in the planar portion to a viewer side can be prevented. Because the reflectance of incident light from external by the planar portion to a viewer side can be reduced, the amount of freedom in selection of the shape of the pyramidal projections, the settings for arrangement, and manufacturing steps can be widened.

In addition, by stacked-layering of a pyramidal projection and a covering film, where there is a difference in indices of refraction therebetween, for light from the atmosphere that is incident on the covering film and the pyramidal projection, there is an effect in that the amount of reflected light is decreased due to the occurrence of optical interference between light reflected at an interface between the atmosphere and the covering film and light reflected at an interface between the covering film and the pyramidal projection.

In the present invention, when the difference between the index of refraction of the covering film and that of the pyramidal projection is high, it is preferable that the film thickness of the covering film be thin.

It is preferable that the pyramidal projection be a shape that has a high number of sides such as a conical shape so that light can be dispersed effectively in a variety of directions, and the level of antireflective function can be increased. Even if the structure is like with a conical shape where there exists a planar portion in-between pyramidal projections, because of the effect in which light is confined within the pyramidal projection by the covering film, the amount of light incident on the planar portion can be reduced, and reflection of light to a viewer side can be prevented.

The pyramidal projection may have a conical shape, a polyhedral shape (triangular pyramid, square pyramid, pentagonal pyramid, hexagonal pyramid, and the like), or a needle shape; the tip of the pyramid may be flat where a cross section thereof is trapezoidal, a dome shape where the tip is rounded, or the like.

Furthermore, by covering of the pyramidal projection with a covering film, physical strength of the pyramidal projection can be increased, and reliability is improved. By selection of a material for the covering film so that the covering film is made to be conductive, other useful functions can be provided, such as granting of an antistatic function and the like.

The FED shown in the present embodiment mode has a high level antireflective function by which the reflection of incident light from external can be reduced by provision of an antireflective layer that has a plurality of pyramidal projections that are covered with covering films, where the covering film has a higher index of refraction than that of the pyramidal projection. For this reason, an FED with excellent visibility can be provided. Consequently, an FED with even higher image quality and higher performance can be manufactured.

Embodiment Mode 4

Figure 22:
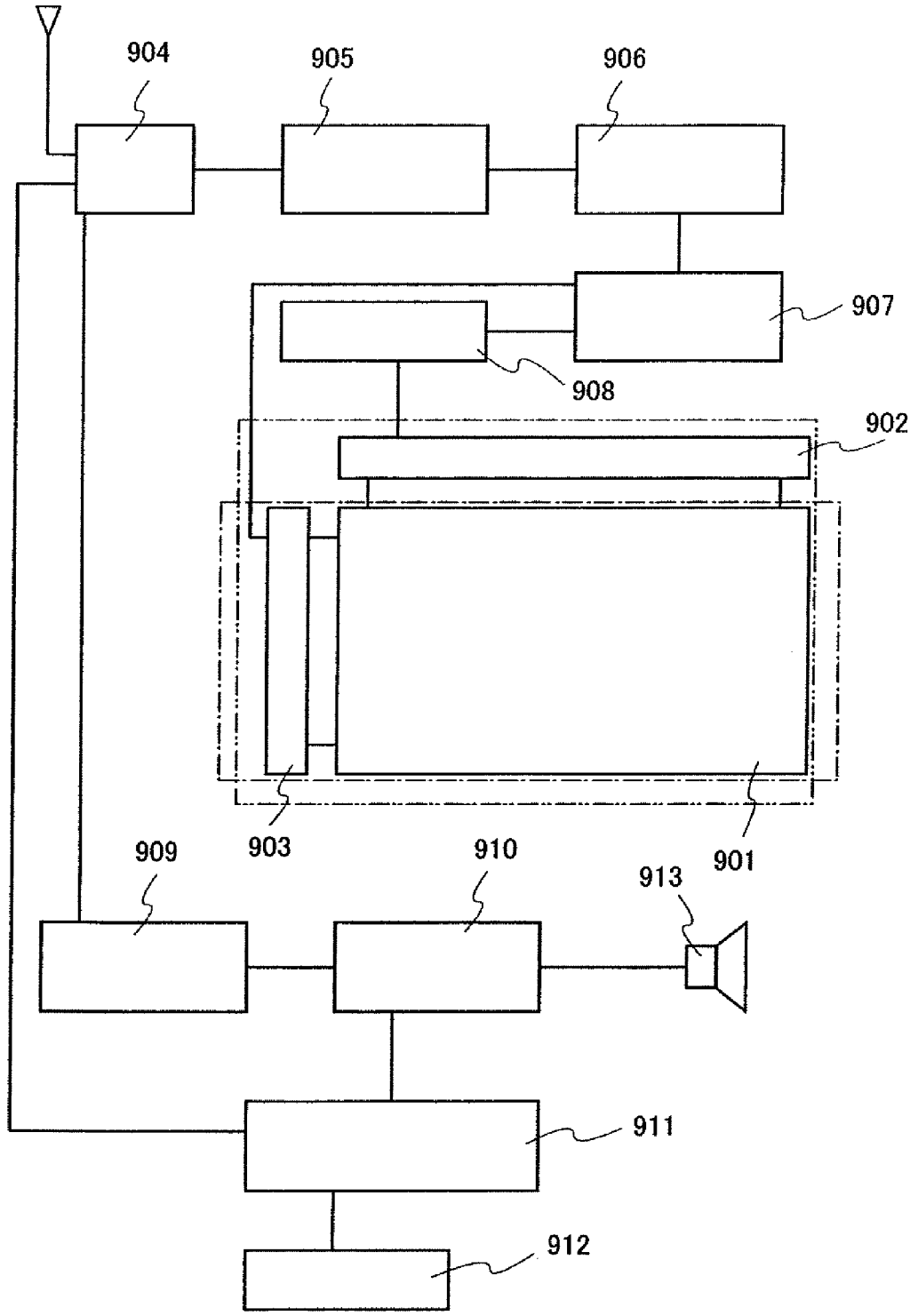
FIG. 22 is a block diagram illustrating the main structure of an electronic device to which the present invention is applied.

By the PDP and FED of the present invention, a television device (also referred to as, simply, a television or a television set) can be completed. In FIG. 22, a block diagram of a main structure of a television device is shown.

Figure 21A:
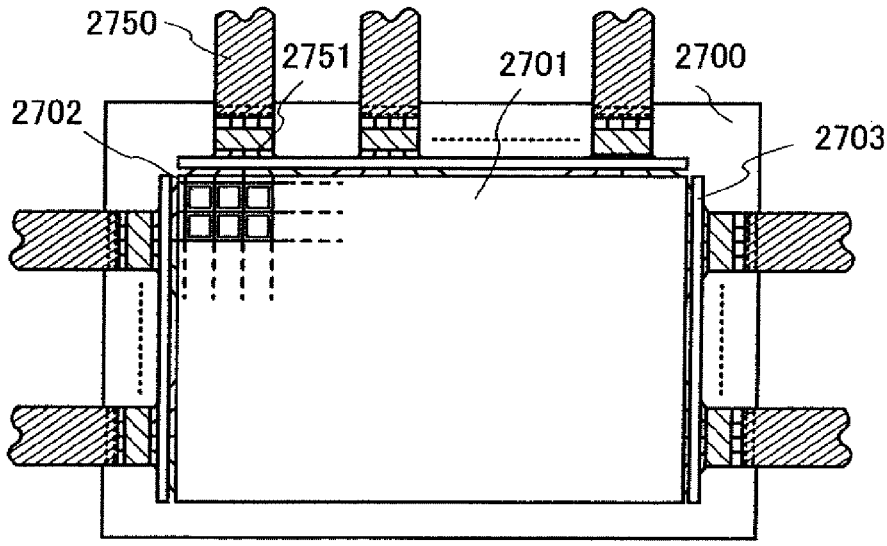
FIGS. 21A and 21B are top-view diagrams illustrating a PDP and an FED of the present invention.

FIG. 21A is a top-view diagram showing a structure of a PDP panel and an FED panel (hereinafter, referred to as display panel) of the present invention. A pixel portion 2701 in which a plurality of pixels 2702 are arranged in matrix and an input terminal 2703 are formed over a substrate 2700 that has an insulating surface. The number of pixels provided may be determined based on a variety of specifications. If display is to be full color display using XGA, which is RGB, the number of pixels may be set to be 1024×768×3 (RGB); if display is to be full color display using UXGA, which is RGB, the number of pixels may be set to be 1600×1200×3 (RGB); and if display is to be full color display using RGB corresponding to full spec. high vision display, the number of pixels may be set to be 1920×1080×3 (RGB).

Figure 21B:
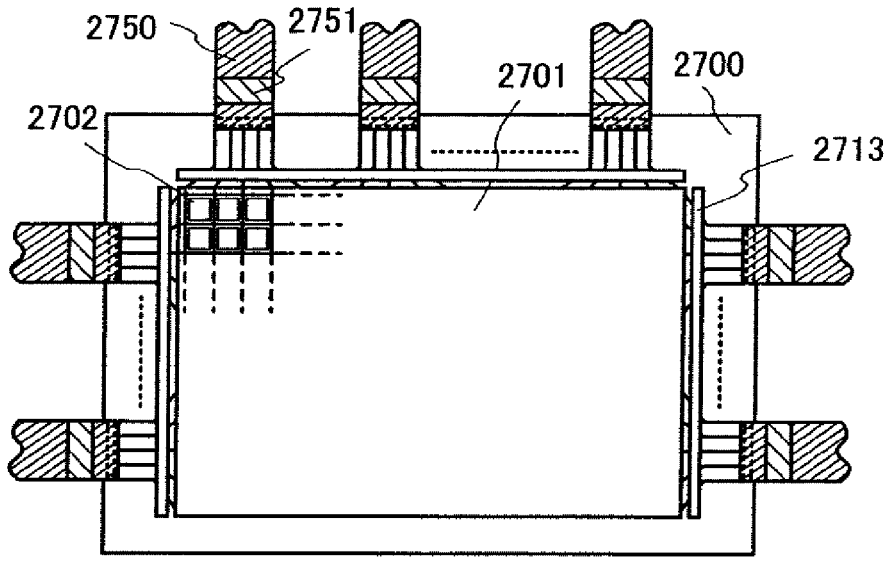

As shown in FIG. 21A, a driver IC 2751 may be mounted on the substrate 2700 by a chip on glass (COG) method. Alternatively, for a different mounting state, a tape automated bonding (TAB) method may be used as shown in FIG. 21B. The driver IC may be a component that is formed on a single crystal semiconductor substrate or a component that is formed of a circuit by TFTs over a glass substrate. In FIGS. 21A and 21B, the driver IC 2751 is connected to a flexible printed circuit (FPC) 2750.

In FIG. 22, for a structure of another external circuit, the external circuit is made up of a video signal amplifier circuit 905 used to amplify video signals out of signals received by a tuner 904 on the input side of the video signal; a video signal processing circuit 906 used to transform signals output from the video signal amplifier circuit 905 into color signals corresponding to each of red, green, and blue; a controller circuit 907 used to transform those video signals into input specifications of the driver IC; and the like. The controller circuit 907 outputs a signal for each of a scanning line side and a signal line side. When digital driving is performed, the structure may be set to be one in which a signal divider circuit 908 is provided on the signal line side and divides input digital signals into an m number of signals and supplies those signals.

Of signals received by the tuner 904, audio signals are transmitted to an audio signal amplifier circuit 909, and the output is supplied to a speaker 913 via an audio signal processing circuit 910. A controller circuit 911 receives receiving station (receiving frequency) and volume control information from an input 912 and outputs signals to the tuner 904 and the audio signal processing circuit 910.

Figure 23A:
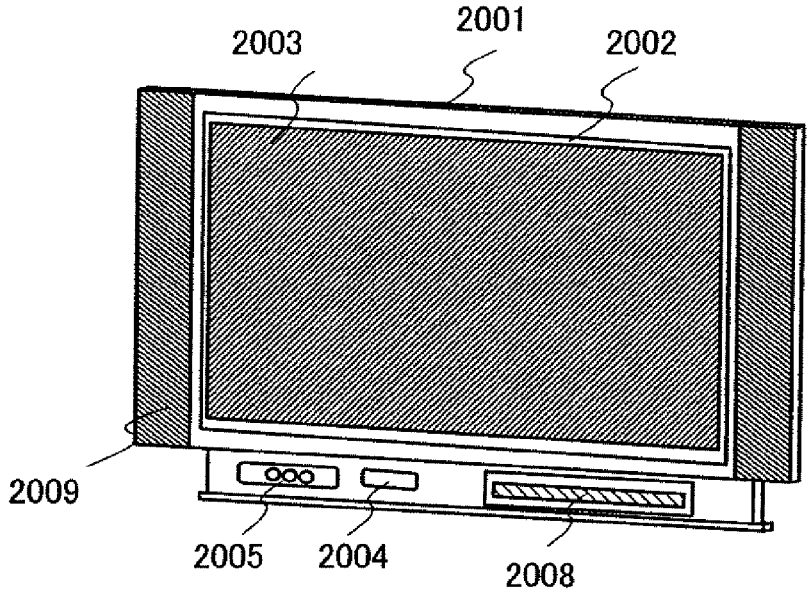
FIGS. 23A and 23B are diagrams illustrating electronic devices of the present invention.
Figure 23B:
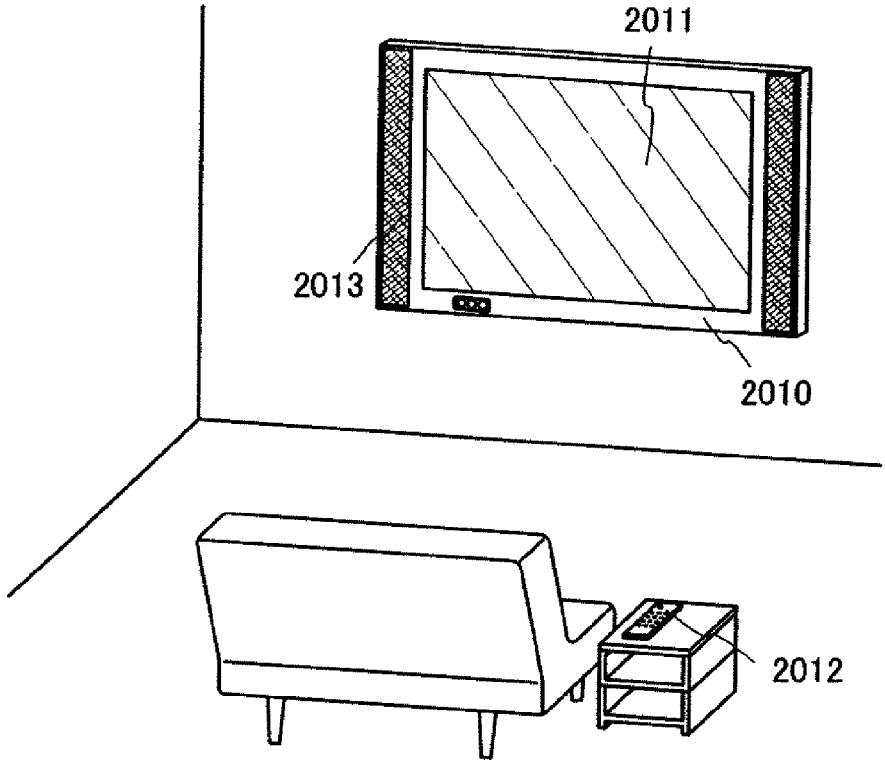

These display modules can be installed in a chassis to complete a television device as shown in FIGS. 23A and 23B. If a PDP module is used for the display module, a PDP television device can be fabricated; if an FED module is used for the display module, an FED television device can be fabricated. In FIG. 23A, a main screen 2003 is formed by a display module, and the main screen 2003 is also equipped with speakers 2009, operation switches, and the like as accessory equipment. In this way, a television device can be completed by use of the present invention.

A display panel 2002 is installed in a chassis 2001, and starting with reception of general television broadcast signals by a receiver 2005, communication of information in one direction (from a transmitter to a receiver) or both directions (between a transmitter and a receiver or between two receivers) or reception of information can be performed via a modem 2004 by connection to a wired or wireless communication network. Operation of the television device can be performed by switches installed in the chassis 2001 or by a remote control device 2006 provided separately, and a display 2007 used to display information output may also be provided in this remote control device 2006.

Furthermore, in addition to the main screen 2003, a subscreen 2008 formed of a second display panel with a structure used to display channel number, volume level, and the like may be added to the television device.

FIG. 23B shows a television device that has a large display, for example, a 20 inch to 80 inch display. The television device includes a chassis 2010, a display 2011, a remote control device 2012 that is an operation portion, speakers 2013, and the like. The present embodiment that uses the present invention is applied to the fabrication of the display 2011. The television display of FIG. 23B is of a type that is attached to a wall so there is no need to widen a space for setup.

Of course, the present invention is not limited to being used in a television device but may be applied to a variety of usage applications as a display medium, starting with monitors for personal computers and also including information display boards in train stations, airports, and the like as well as displays with large areas such as advertisement displays and the like on the street.

The present embodiment mode can be combined with any of Embodiment Modes 1 through 3 as appropriate.

Embodiment Mode 5

For electronic devices that use the PDP and FED of the present invention, television devices (also referred to as simply televisions or television sets); cameras such as digital cameras, digital video cameras, and the like; portable telephone devices (also referred to as simply cellular phone receivers or cellular phones), portable information terminals such as PDAs and the like; portable game machines; computer monitors; computers; audio playback devices such as car audio and the like; video playback devices, which are equipped with storage media, such as home game machines and the like; and the like can be given. Furthermore, the PDP and FED of the present invention can be applied to all manner of game machines, such as pachinko machines, slot machines, pinball machines, large-scale game machines, and the like, that have a display device. Specific examples will be described with reference to FIGS. 24A to 24F.

Figure 24A:
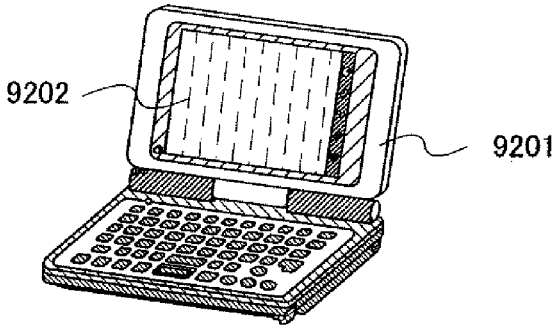
FIGS. 24A to 24E are diagrams illustrating electronic devices of the present invention.

A portable information terminal device shown in FIG. 24A has a main body 9201, a display 9202, and the like. For the display 9202, an FED of the present invention can be applied. As a result, a highly functional portable information terminal device by which high quality images with excellent visibility can be displayed can be provided.

Figure 24B:
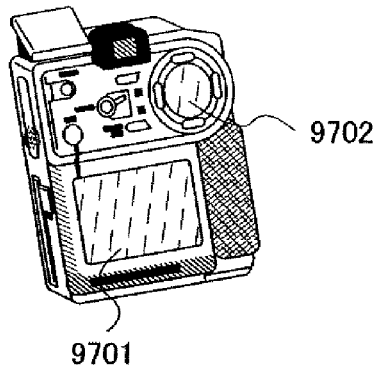

A digital video camera shown in FIG. 24B has a display 9701, a display 9702, and the like. For the display 9701, an FED device of the present invention can be applied. As a result, a highly functional portable information terminal device by which high quality images with excellent visibility can be displayed can be provided.

Figure 24C:
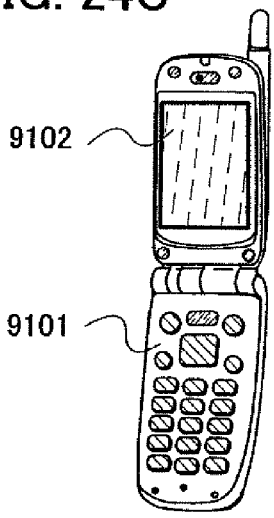

A cellular phone device shown in FIG. 24C has a main body 9101, a display 9102, and the like. For the display 9102, an FED device of the present invention can be applied. As a result, a highly functional portable information terminal device by which high quality images with excellent visibility can be displayed can be provided.

Figure 24D:
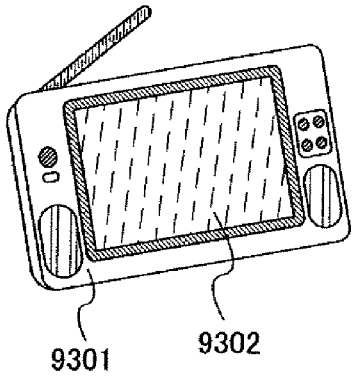

A portable television device shown in FIG. 24D has a main body 9301, a display 9302, and the like. For the display 9302, an FED device of the present invention can be applied. As a result, a highly functional portable information terminal device by which high quality images with excellent visibility can be displayed can be provided. Furthermore, for the television device, the PDP and FED of the present invention can be applied to a wide range of television devices, from small devices installed in portable terminals such as cellular phone devices and the like as well as mid-sized devices that can be picked up and carried, all the way up to large-sized devices (for example, displays of 40 inches and above).

Figure 24E:
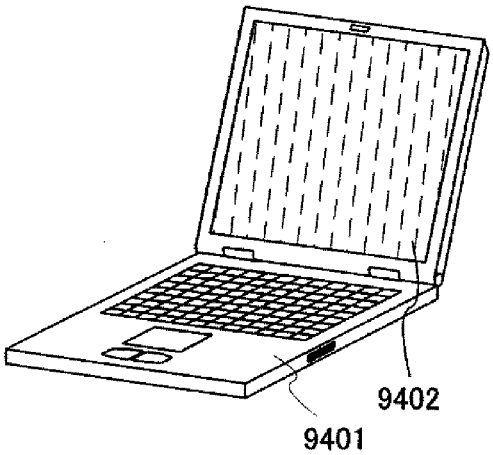

A portable computer shown in FIG. 24E has a main body 9401, a display 9402, and the like. For the display 9402, an FED device of the present invention can be applied. As a result, a highly functional portable information terminal device by which high quality images with excellent visibility can be displayed can be provided.

A slot machine shown in FIG. 24F has a main body 9501, a display 9502, and the like. For the display 9502, an FED device of the present invention can be applied. As a result, a highly functional portable information terminal device by which high quality images with excellent visibility can be displayed can be provided.

In this way, by the PDP and the FED of the present invention, highly functional electronic devices by which high quality images with excellent visibility can be displayed can be provided.

The present embodiment mode can be combined with any of Embodiment Modes 1 through 4 as appropriate.

Embodiment 1

In the present embodiment, the results of optical calculations of a model of an antireflective layer used in the present invention will be described. Furthermore, optical calculations for a pyramidal projection only were performed as a comparative example. The present embodiment will be described using FIG. 8, FIGS. 27A to 27C, FIGS. 28A to 28C, and FIGS. 29A to 29C.

Optical calculations were performed for a comparative example of a conical-shaped pyramidal projection (index of refraction of 1.35) and for a conical-shaped pyramidal projection (index of refraction of 1.35) that is covered by a covering film (index of refraction of 1.9) (which is referred to as Structure A). For comparative example 1, the height H1 of the pyramidal projection was 1500 nm and the width L1 thereof was 300 nm. For Structures A1 through A4, the height H2 of the pyramidal projection and the covering film was set to be 1500 nm and the width L2 thereof was set to be 300 nm. The difference d in height between the apex of the pyramidal projection and the apex of the covering film was 60 nm for Structure A1, 45 nm for Structure A2, 40 nm for Structure A3, and 35 nm for Structure A4. In Structures A1 through A4, the height H1 of the pyramidal projection is changed according to the difference d in height between the apex of the pyramidal projection and the apex of the covering film. The width L1 of the pyramidal projection was changed so that the ratio between the height H1 of the pyramidal projection and the width L1 of the base was always 5. It is to be noted that pyramidal projections covered by a plurality of covering films were placed adjacent to each other so as to be more closely and densely arranged so that, with respect to one pyramidal projection, six pyramidal projections came into contact with each other via a covering film.

Figure 8:
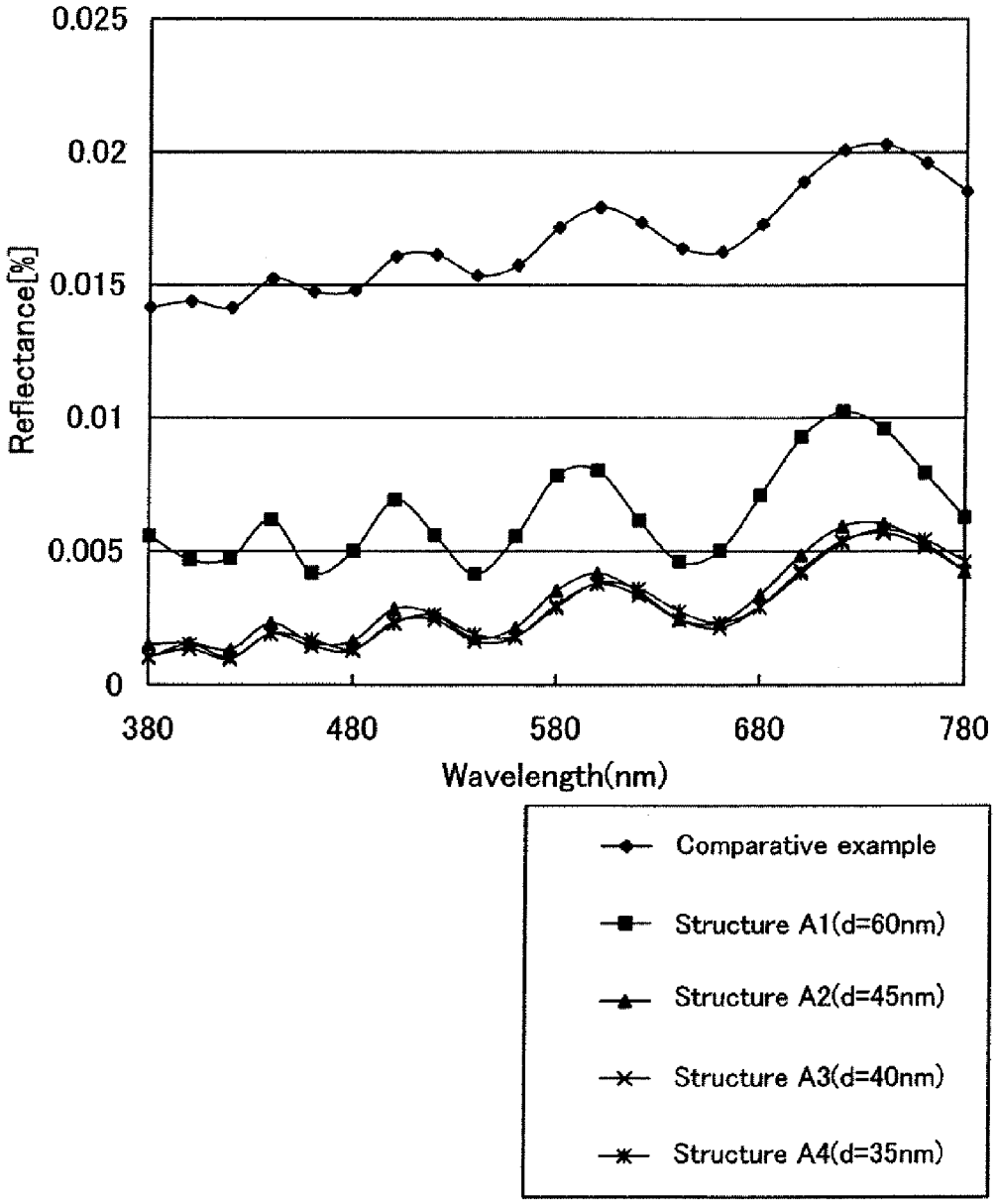
FIG. 8 is a graph showing experimental data for Embodiment 1.

For the calculations of the present invention, the optical calculation simulator Diffract MOD (produced by RSoft Design Group Japan KK) for optical devices was used. Optical calculations were performed in three dimensions, and calculations for reflectance were calculated. The relationship between wavelength of light and reflectance for the comparative example and each of Structures A1 to A4 is shown in FIG. 8. Furthermore, for calculation conditions, harmonics, a parameter of the aforementioned calculation simulator, were set to be 3 in both the X and Y directions. In addition, for conical projections and hexagonal pyramidal projections, with the pitch distance between apexes of pyramidal projections defined as p and the height of the pyramidal projection defined as b, index resolution, a parameter of the aforementioned calculation simulator, was set to be the calculated values of $((\sqrt{3})\times p/512)$ in the X direction; $(p/512)$ in the Y direction; and $(b/80)$ in the Z direction.

In FIG. 8, the relationship between wavelength of light and reflectance is indicated by a diamond-shaped data marker for Comparative Example 1, by a square data marker for Structure A1, by a triangular data marker for Structure A2, by an x-shaped data marker for Structure A3, and by an asterisk data marker for Structure A4. In the model of the pyramidal projection covered by the covering film of Structures A1 to A4 to which the present invention is applied, for optical calculations, as well, measured at wavelengths of from 380 nm to 780 nm, the reflectance was lower for Structures A1 to A4 than for the comparative example, and it was confirmed that the amount of reflection could be reduced. Furthermore, in Structures A1 to A4, if the difference d in height between the apex of the pyramidal projection and the apex of the covering film was set to be 45 nm (Structure A2), 40 nm (Structure A3), and 35 nm (Structure A4), the reflectance could be suppressed to an even lower percentage.

Figure 27A:
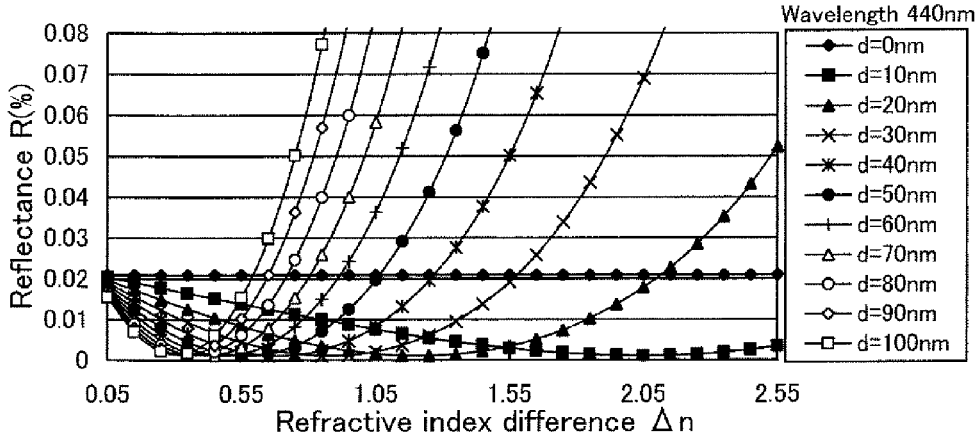
FIGS. 27A to 27C are graphs showing experimental data for Embodiment 1.
Figure 27B:
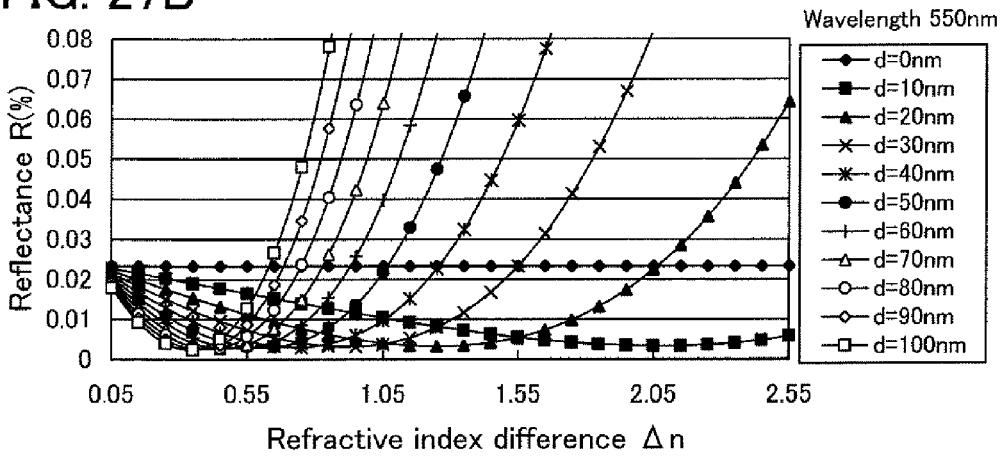
Figure 27C:
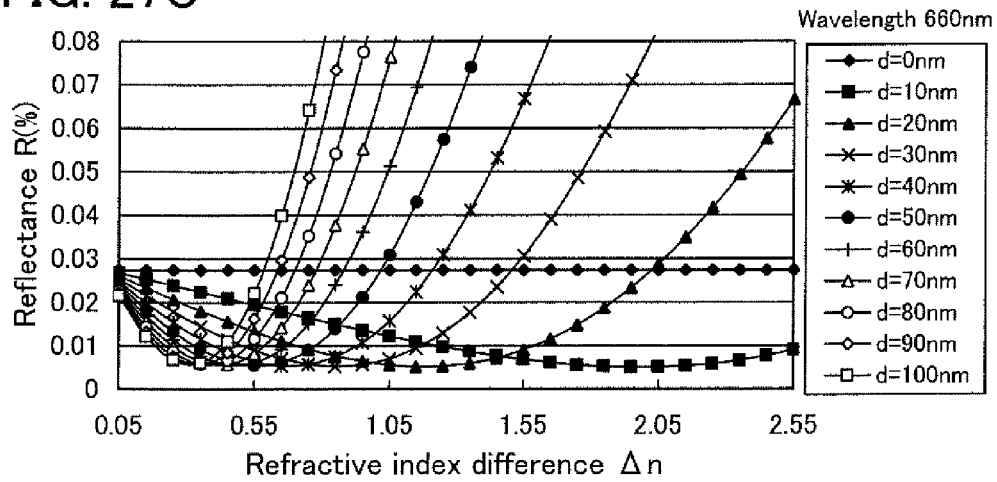

Next, in the model of the pyramidal projection covered by the covering film using the present invention, the difference Δn in index of refraction between that of the pyramidal projection and that of the covering film and the difference d in height between the apex of the pyramidal projection and the apex of the covering film were changed, and the change in reflectance with respect to each wavelength was calculated. The height H2 of the pyramidal projection and the covering film was set to be 1500 nm and the width L2 thereof was set to be 300 nm, and the height H1 of the pyramidal projection was changed according to the difference d in height between the apex of the pyramidal projection and the apex of the covering film. The index of refraction of the pyramidal projection was set to be 1.49, the index of refraction of the covering film was changed, and calculations were performed. In FIGS. 27A to 27C, changes in the reflectance R (%) with respect to the difference Δn in index of refraction between that of the pyramidal projection and that of the covering film are shown for when the difference d in height between the apex of the pyramidal projection and the apex of the covering film was changed to 0 nm (black diamond-shaped data marker), 10 nm (black square data marker), 20 nm (black triangular data marker), 30 nm (x-shaped data marker), 40 nm (asterisk data marker), 50 nm (black circular data marker), 60 nm (cross data marker), 70 nm (triangular data marker), 80 nm (circular data marker), 90 nm (diamond-shaped data marker), and 100 nm (square data marker).

Figure 28A:
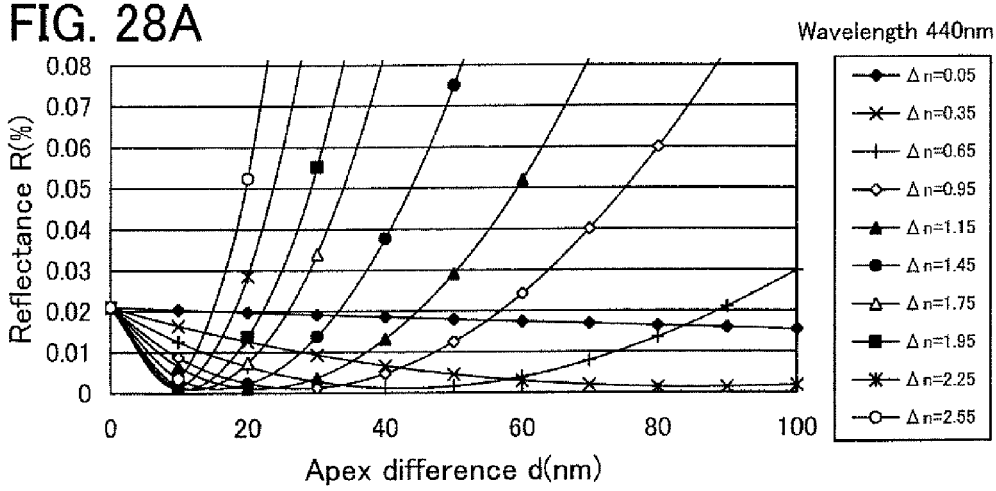
FIGS. 28A to 28C are graphs showing experimental data for Embodiment 1.
Figure 28B:
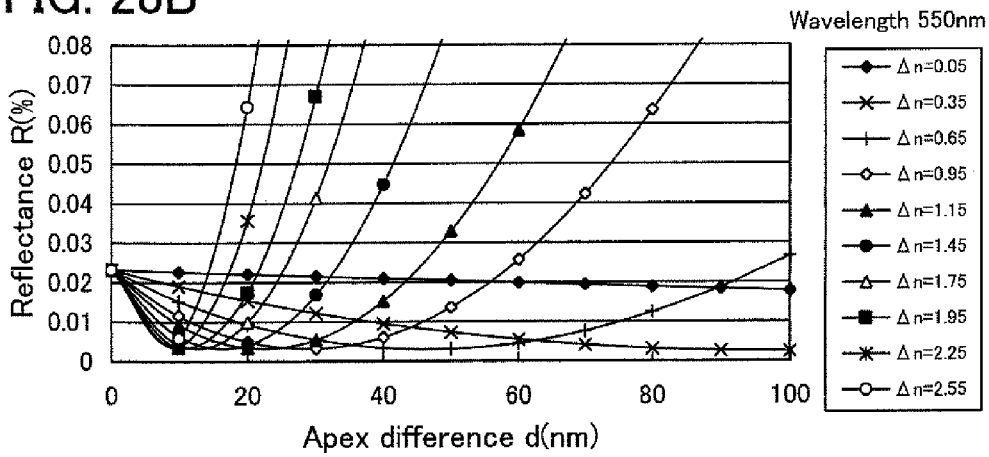
Figure 28C:
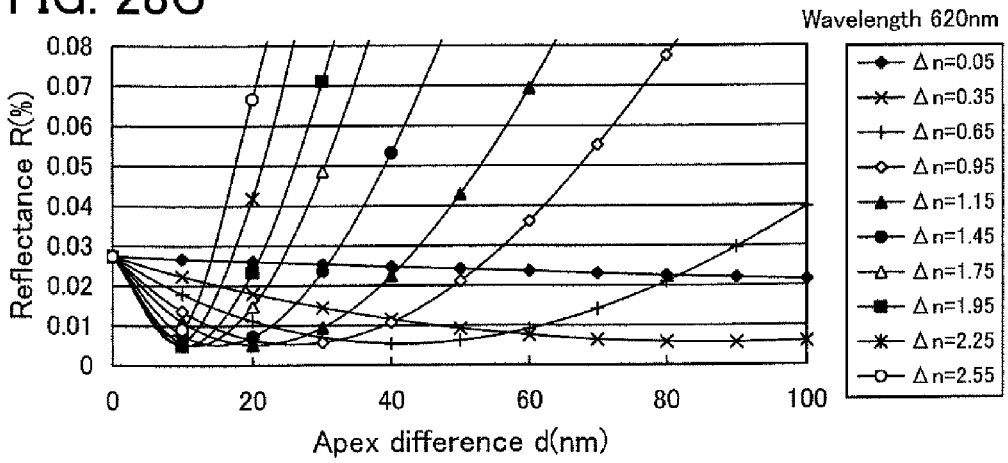

In FIGS. 28A to 28C, changes in the reflectance R (%) with respect to the difference d in height between the apex of the pyramidal projection and the apex of the covering film are shown for when the difference Δn in index of refraction between that of the pyramidal projection and that of the covering film was changed to 0.05 (black diamond-shaped data marker), 0.35 (x-shaped data marker), 0.65 (cross data marker), 0.95 (diamond-shaped data marker), 1.15 (black triangular data marker), 1.45 (black circular data marker), 1.75 (triangular data marker), 1.95 nm (square data marker), 2.25 (asterisk data marker), and 2.55 (circular data marker). Results of calculations performed for wavelengths of light in the visible light region of the electromagnetic spectrum are shown for blue at 440 nm (FIG. 27A and FIG. 28A), green at 550 nm (FIG. 27B and FIG. 28B), and red at 620 nm (FIG. 27C and FIG. 28C).

In FIGS. 27A to 27C, the reflectance increases as the difference d in height between the apex of the pyramidal projection and the apex of the covering film increases, and this tendency becomes prominent as the difference Δn in index of refraction between that of the pyramidal projection and that of the covering film increases. In FIGS. 28A to 28C, the reflectance increases as the difference Δn in index of refraction between that of the pyramidal projection and that of the covering film increases, and this tendency becomes prominent as the difference Δn in index of refraction between that of the pyramidal projection and that of the covering film increases.

Figure 29A:
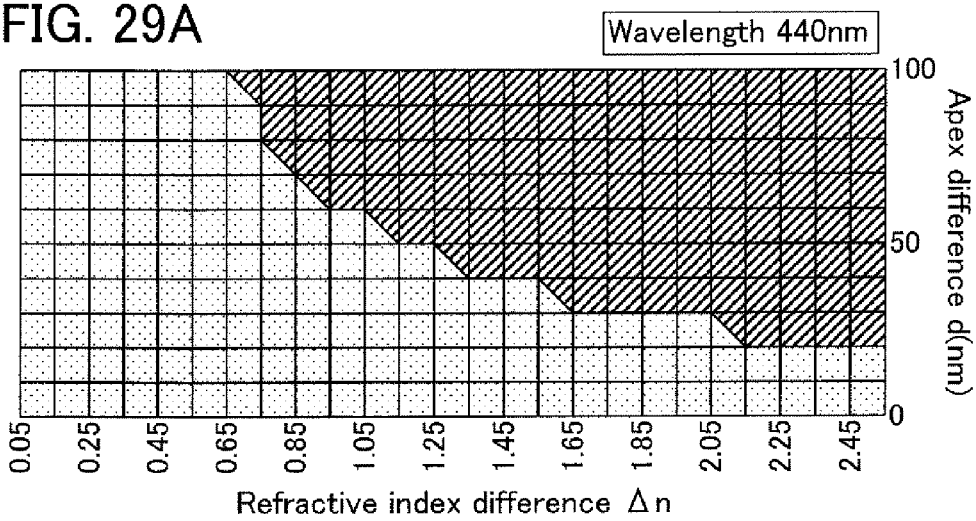
FIGS. 29A to 29C are graphs showing experimental data for Embodiment 1.
Figure 29B:
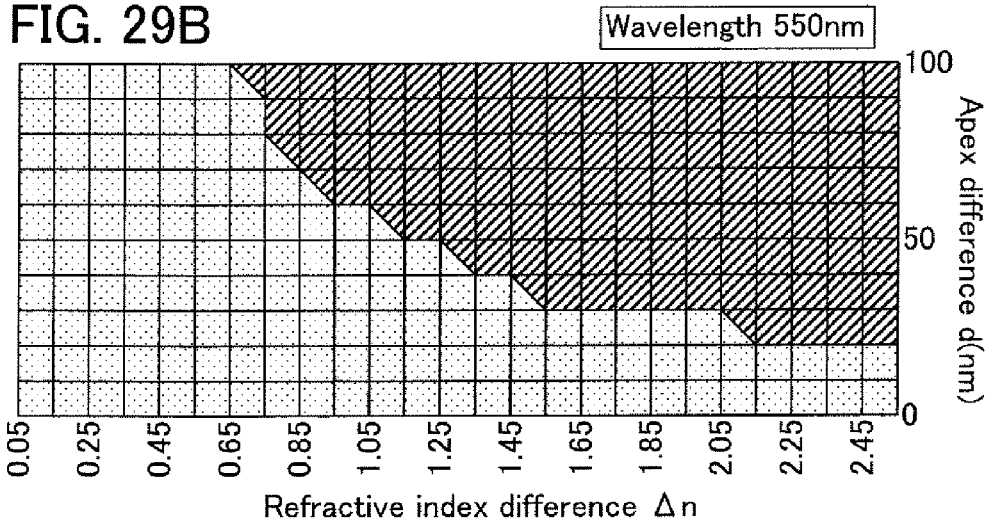
Figure 29C:
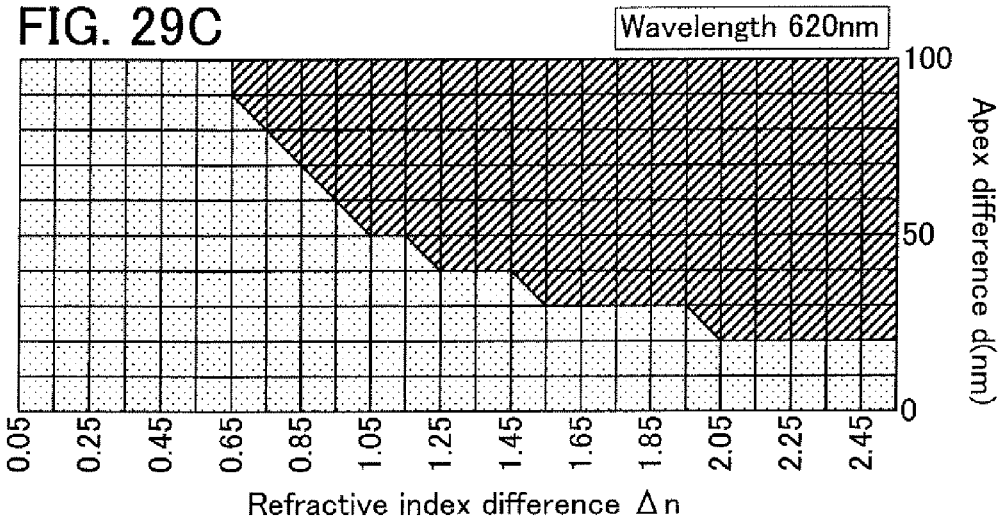

In FIGS. 29A to 29C, the relationship between the difference d in height between the apex of the pyramidal projection and the apex of the covering film, the difference Δn in index of refraction between that of the pyramidal projection and that of the covering film, and the reflectance are shown. In FIGS. 29A to 29C, the reflectance of the pyramidal projection when no covering film is provided is set as a reference, and cases where the reflectance for when the difference in height between the apex of the pyramidal projection and the apex of the covering film is d is lower than the reference reflectance were given in a region shaded by dots and cases where the reflectance is higher were given in a region shaded by diagonal lines. FIG. 29A is a graph for when the reflectance of 0.021% for light with a wavelength of 440 nm and for no covering film was set as a reference, FIG. 29B is a graph for when the reflectance of 0.023% for light with a wavelength of 550 nm and for no covering film was set as a reference, and FIG. 29C is a graph for when the reflectance of 0.027% for light with a wavelength of 620 nm and for no covering film was set as a reference.

From the graphs of FIGS. 29A to 29C, when the difference Δn in index of refraction between that of the pyramidal projection and that of the covering film is greater than or equal to 0.05 and less than or equal to 0.65, cases where the difference d in height between the apex of the pyramidal projection and the apex of the covering film is 100 nm or less are preferable because the reflectance can be suppressed to be lower in this case than the reference reflectance for when no covering film is formed. From the graphs of FIGS. 29A to 29C, when the difference Δn in index of refraction between that of the pyramidal projection and that of the covering film is greater than or equal to 0.65 and less than or equal to 1.15, cases where the difference d in height between the apex of the pyramidal projection and the apex of the covering film is 50 nm or less are preferable because the reflectance can be suppressed to be lower in this case than the reference reflectance for when no covering film is formed. Moreover, it is preferable that the difference d in height between the apex of the pyramidal projection and the apex of the covering film be greater than or equal to 1 nm.

Because the difference d in height between the apex of the pyramidal projection and the apex of the covering film and the film thickness of the covering film depend on each other and change in the same way, the trend for how the difference d in height between the apex of the pyramidal projection and the apex of the covering film changes could also be referred to as the trend for how the film thickness of the covering film changes.

From the above description, it was confirmed that it is preferable that the film thickness of the covering film (the difference in height between the apex of the pyramidal projection and the apex of the covering film) be thin when the difference in index of refraction between that of the pyramidal projection and that of the covering film is great.

The antireflective layer described in the present invention has a plurality of pyramidal projections that are covered with covering films, each of which has a higher index of refraction than that of the pyramidal projection, and it was confirmed that a high level antireflective function could be obtained thereby.

This application is based on Japanese Patent Application serial no. 2006-328265 filed with the Japan Patent Office on Dec. 5, 2006, the entire contents of which are hereby incorporated by reference.

The invention claimed is:

1. A plasma display panel comprising:

a pair of substrates;

at least one pair of electrodes provided between the pair of substrates;

a phosphor layer provided between the pair of electrodes; and an antireflective layer provided over an outer side of one of the pair of substrates, wherein the one of the pair of substrates has a light-transmitting property, wherein the antireflective layer comprises a plurality of pyramidal projections that lie adjacent to each other with a space, wherein each of the plurality of pyramidal projections is covered by a covering film, wherein an index of refraction of the covering film is higher than an index of refraction of the pyramidal projection, wherein one of the plurality of pyramidal projections has a first portion having a first refractive index and a second portion having a second refractive index different from the first refractive index, wherein the first portion is closer to the one of the pair of substrates than the second portion, and wherein the first refractive index has a closer refractive index to a refractive index of the one of the pair of substrates than the second refractive index.

2. The plasma display panel according to claim 1, wherein the covering film conforms to the pyramidal projections.

3. The plasma display panel according to claim 1, wherein the difference between the index of refraction of the covering film and the index of refraction of the pyramidal projections is greater than or equal to 0.05 and less than or equal to 0.65, and wherein the difference in a height of an apex of the covering film and a height of an apex of the pyramidal projections is 100 nm or less.

4. The plasma display panel according to claim 1, wherein the difference between the index of refraction of the covering film and the index of refraction of the pyramidal projections is greater than or equal to 0.65 and less than or equal to 1.15, and wherein the difference in a height of an apex of the covering film and a height of an apex of the pyramidal projections is 50 nm or less.

5. The plasma display panel according to claim 1, wherein the pyramidal projections have a conical shape.

6. A plasma display panel comprising:

a pair of substrates;

at least one pair of electrodes provided between the pair of substrates;

a phosphor layer provided between the pair of electrodes; and an antireflective layer provided over an outer side of one of the pair of substrates, wherein the one of the pair of substrates has a light-transmitting property, wherein the antireflective layer comprises a plurality of pyramidal projections, wherein each of the plurality of pyramidal projections is covered by a covering film, wherein an index of refraction of the covering film is higher than an index of refraction of the pyramidal projection, wherein a distance lies between at least one side of a base of one of the pyramidal projections and one side of a base of an adjacent pyramidal projection, wherein one of the plurality of pyramidal projections has a first portion having a first refractive index and a second portion having a second refractive index different from the first refractive index, wherein the first portion is closer to the one of the pair of substrates than the second portion, and wherein the first refractive index has a closer refractive index to a refractive index of the one of the pair of substrates than the second refractive index.

7. The plasma display panel according to claim 6, wherein the covering film conforms to the pyramidal projections.

8. The plasma display panel according to claim 6, wherein the difference between the index of refraction of the covering film and the index of refraction of the pyramidal projections is greater than or equal to 0.05 and less than or equal to 0.65, and wherein the difference in a height of an apex of the covering film and a height of an apex of the pyramidal projections is 100 nm or less.

9. The plasma display panel according to claim 6, wherein the difference between the index of refraction of the covering film and the index of refraction of the pyramidal projections is greater than or equal to 0.65 and less than or equal to 1.15, and wherein the difference in a height of an apex of the covering film and a height of an apex of the pyramidal projections is 50 nm or less.

10. The plasma display panel according to claim 6, wherein the pyramidal projections have a conical shape.

11. A plasma display panel comprising:

a pair of substrates;

at least one pair of electrodes provided between the pair of substrates;

a phosphor layer provided between the pair of electrodes; and an antireflective layer provided over an outer side of one of the pair of substrates, wherein the one of the pair of substrates has a light-transmitting property, wherein the antireflective layer comprises a plurality of pyramidal projections, wherein each of the plurality of pyramidal projections is covered by a covering film, wherein an index of refraction of the covering film is higher than an index of refraction of the pyramidal projection, wherein one of the plurality of pyramidal projections has a first portion having a first refractive index and a second portion having a second refractive index different from the first refractive index, wherein the first portion is closer to the one of the pair of substrates than the second portion, and wherein the first refractive index has a closer refractive index to a refractive index of the one of the pair of substrates than the second refractive index, wherein the plurality of pyramidal projections comprise a first pyramidal projection and a second pyramidal projection, and wherein the first pyramidal projection and the second pyramidal projection lie adjacent to each other with a space.

12. The plasma display panel according to claim 11, wherein the covering film conforms to the pyramidal projections.

13. The plasma display panel according to claim 11, wherein the difference between the index of refraction of the covering film and the index of refraction of the pyramidal projections is greater than or equal to 0.05 and less than or equal to 0.65, and wherein the difference in a height of an apex of the covering film and a height of an apex of the pyramidal projections is 100 nm or less.

14. The plasma display panel according to claim 11, wherein the difference between the index of refraction of the covering film and the index of refraction of the pyramidal projections is greater than or equal to 0.65 and less than or equal to 1.15, and wherein the difference in a height of an apex of the covering film and a height of an apex of the pyramidal projections is 50 nm or less.

15. The plasma display panel according to claim 11, wherein the pyramidal projections have a conical shape.

* * * * *